US009090960B2

(12) United States Patent
Maruyama et al.

(10) Patent No.: US 9,090,960 B2
(45) Date of Patent: Jul. 28, 2015

(54) STRAIN AGING HARDENING STEEL SHEET EXCELLENT IN AGING RESISTANCE, AND MANUFACTURING METHOD THEREOF

(75) Inventors: Naoki Maruyama, Tokyo (JP); Koji Hashimoto, Tokyo (JP); Masaharu Kameda, Tokyo (JP)

(73) Assignee: NIPPON STEEL AND SUMITOMO METAL CORPORATION, Tokyo (JP)

( * ) Notice: Subject to any disclaimer, the term of this patent is extended or adjusted under 35 U.S.C. 154(b) by 262 days.

(21) Appl. No.: 13/988,513

(22) PCT Filed: Jun. 22, 2011

(86) PCT No.: PCT/JP2011/064317

§ 371 (c)(1),
(2), (4) Date: May 21, 2013

(87) PCT Pub. No.: WO2012/070271

PCT Pub. Date: May 31, 2012

(65) Prior Publication Data

US 2013/0248060 A1 Sep. 26, 2013

(30) Foreign Application Priority Data

Nov. 22, 2010 (JP) ..... 2010-260590

(51) Int. Cl.
*C22C 38/22* (2006.01)
*C22C 38/28* (2006.01)
(Continued)

(52) U.S. Cl.
CPC ..... *C22C 38/50* (2013.01); *C21D 8/0263* (2013.01); *C21D 9/46* (2013.01); *C22C 1/02* (2013.01);
(Continued)

(58) Field of Classification Search
None
See application file for complete search history.

(56) References Cited

U.S. PATENT DOCUMENTS 5,690,755 A * 11/1997 Yoshinaga et al. ..... 148/533
5,853,903 A * 12/1998 Hosoya et al. ..... 428/669
(Continued)

FOREIGN PATENT DOCUMENTS

CN 101278066 A 10/2008
CN 101652495 A 2/2010
(Continued)

OTHER PUBLICATIONS

Taiwanese Office Action issued on Aug. 20, 2013 in Taiwanese Patent Application No. 100142715.
International Search Report for PCT/JP2011/064317 dated Aug. 30, 2011.
(Continued)

*Primary Examiner* — Deborah Yee
(74) *Attorney, Agent, or Firm* — Birch, Stewart, Kolasch & Birch, LLP

(57) ABSTRACT

A strain aging hardening type steel sheet excellent in aging resistance, and manufacturing method thereof, said steel sheet comprises: in mass %, C: 0.0010 to 0.010%; Si: 0.005 to 1.0%; Mn: 0.08 to 1.0%; P: 0.003 to 0.10%; S: 0.0005 to 0.020%; Al: 0.010 to 0.10%; Cr: 0.005 to 0.20%; Mo: 0.005 to 0.20%; Ti: 0.002 to 0.10%; Nb: 0.002 to 0.10%; N: 0.001 to 0.005%; and a balance being composed of Fe and inevitable impurities, in which a ferrite fraction is 98% or more, an average grain diameter of ferrite is 5 to 30 μm, a minimum value of dislocation density in a portion having a ½ thickness of a sheet thickness and a minimum value of dislocation density in a surface layer portion are each $5\times10^{12}/m^2$ or more, and an average dislocation density falls within a range of $5\times10^{12}$ to $1\times10^{15}/m^2$.

16 Claims, 3 Drawing Sheets

(51) Int. Cl.

| | |
|---|---|
| ***C22C 38/26*** | (2006.01) |
| ***C21D 8/02*** | (2006.01) |
| ***C22C 38/50*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/24*** | (2006.01) |
| ***C22C 38/32*** | (2006.01) |
| ***C22C 38/44*** | (2006.01) |
| ***C22C 38/48*** | (2006.01) |
| ***C22C 1/02*** | (2006.01) |

(52) U.S. Cl.

CPC ..... *C22C 38/001* (2013.01); *C22C 38/002* (2013.01); *C22C 38/004* (2013.01); *C22C 38/005* (2013.01); *C22C 38/008* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/44* (2013.01); *C22C 38/48* (2013.01); *C21D 2211/005* (2013.01)

(56) References Cited

U.S. PATENT DOCUMENTS

| | | | | |
|---|---|---|---|---|
| 6,217,675 | B1 * | 4/2001 | Taniguchi et al. | 148/328 |
| 6,623,691 | B2 * | 9/2003 | Vandeputte et al. | 420/126 |
| 7,101,445 | B2 * | 9/2006 | Kami et al. | 148/320 |
| 8,876,986 | B2 * | 11/2014 | Hata et al. | 148/320 |
| 2002/0197508 | A1 | 12/2002 | Yoshinaga et al. | |
| 2009/0255610 | A1 | 10/2009 | Yoshinaga et al. | |
| 2010/0078097 | A1 | 4/2010 | Yoshida et al. | |

FOREIGN PATENT DOCUMENTS

| | | | |
|---|---|---|---|
| JP | 62-109927 | A | 5/1987 |
| JP | 04-120271 | A | 4/1992 |
| JP | 2000-017386 | A | 1/2000 |
| JP | 2002-53933 | A | 2/2002 |
| JP | 200-235117 | A | 8/2002 |
| JP | 2003-64446 | A | 3/2003 |
| JP | 2007-077511 | A | 3/2007 |
| JP | 2008-110387 | A | 5/2008 |
| JP | 2008-115426 | A | 5/2008 |
| JP | 2009-102673 | A | 5/2009 |
| KR | 10-2002-0035653 | A | 5/2002 |

OTHER PUBLICATIONS

Korean Office Action, issued Nov. 27, 2014, for Korean Application No. 10-2013-7012847.

Chinese Office Action, dated Jul. 2, 2014, for Chinese Application No. 201180056325.6.

* cited by examiner

STRAIN AGING HARDENING STEEL SHEET EXCELLENT IN AGING RESISTANCE, AND MANUFACTURING METHOD THEREOF

TECHNICAL FIELD

The present invention relates to a strain aging hardening type steel sheet excellent in aging resistance after baking finish, and a manufacturing method thereof.

BACKGROUND ART

A steel sheet for an outer sheet used for a side panel, a hood, or the like of an automobile has required panel rigidity and a dent resistance property (denting property). For improving the above denting property, it is effective to increase yield strength. On the other hand, for suppressing occurrence of surface strain to secure high surface accuracy when performing press forming, the yield strength is required to be decreased.

As a steel sheet that satisfies such two contradictory properties to achieve press formability and an increase in strength, a bake hardening (BH) steel sheet has been developed. The above BH steel sheet is a steel sheet whose yield strength increases by the baking finish treatment after press forming.

Here, the BH steel sheet will be explained in detail. FIG. 1A is a graph schematically showing a variation over time of yield strength of a conventional BH steel sheet. During the baking treatment after coating (while the steel sheet being heated to about 170° C. normally and maintained for several dozen minutes), C and N remaining in solution in the steel sheet diffuse to dislocation introduced at the time of press forming to firmly fix to the above dislocation, and thereby the yield strength increases. The above increased part of the yield strength is a bake hardening amount (BH amount), and the BH amount increases by increasing the content of solid solution C or the content of solid solution N in general.

However, such a hardening mechanism has the following problems. FIG. 1B is a graph schematically showing a variation over time of the yield strength of the conventional BH steel sheet in the case when the content of solid solution C or the content of solid solution N has been increased.

When the content of solid solution C or the content of solid solution N is increased in order to increase the BH amount, as shown in FIG. 1B, part of the dislocation is already fixed firmly by the solid solution C or the solid solution N before press forming (natural aging). Then, at the time of press forming, a wavy surface defect called stretcher strain occurs due to yield point elongation, and thereby a product property deteriorates remarkably. Furthermore, after baking finish, the solid solution C and the solid solution N precipitate as iron carbides and iron nitrides. Thereafter, as time passes, the carbides and nitrides grow, and further as the progress of coarsening continues, the yield strength decreases significantly.

It has been considered difficult to solve the above natural aging problem and to achieve a steel sheet satisfying both the natural aging resistance and the excellent bake hardenability, which has been a longstanding problem.

With regard to the above problem, there has been disclosed a method of adding Mo to thereby achieve bake hardenability and aging hardenability in Patent Document 1, Patent Document 2, and Patent Document 3.

Further, in Patent Document 4, there has been disclosed a method of controlling a rolling line load at the time of temper rolling and a steel sheet shape in the temper rolling to thereby prevent the occurrence of stretcher strain.

PRIOR ART DOCUMENT

Patent Document

[Patent Document 1] Japanese Laid-open Patent Publication No. S62-109927
[Patent Document 2] Japanese Laid-open Patent Publication No. H4-120217
[Patent Document 3] Japanese Laid-open Patent Publication No. 2000-17386
[Patent Document 4] Japanese Laid-open Patent Publication No. 2002-235117

DISCLOSURE OF THE INVENTION

Problems to be Solved by the Invention

However, in Patent Document 1 and Patent Document 2, the range of a single composition of Mo has been defined, but there is a possibility that the hardening is obtained or not depending on the content of C, and the contents of Ti and Nb. For example, the added amount of Mo has been described in the prior art that its range is 0.001 to 3.0% or 0.02 to 0.16%. However, only such control of the added amount of Mo is not sufficient to stabilize the function of which Mo is added to improve the bake hardenability of the steel sheet, resulting in that there sometimes arises a case that 50 MPa of the bake hardening amount can be obtained or a case that only 10 MPa is obtained.

Further, in Patent Document 3, not only the range of the composition of Mo, but also dislocation density has been defined. However, even a steel sheet in Patent Document 3 has a possibility that after the bake hardening, the yield strength decreases as time passes.

Furthermore, in Patent Document 4, controlling of the rolling line load and the steel sheet shape at the time of temper rolling has been defined. In Patent Document 4, tension at the time of temper rolling, which is an important parameter affecting the uniformity of the dislocation density in the steel sheet, and a correlation between the above tension and the rolling line load have not been defined. Further, the prevention of the occurrence of stretcher strain after the temper rolling has been mentioned, but the aging property after press forming and baking finish has not been mentioned, and thus maintaining the yield strength, securing the denting property, and so on have been unstable.

The present inventors elucidated that the yield strength that has once increased due to strain aging hardening by the baking finish treatment begins to decrease after the baking finish treatment, thereby causing deterioration of the denting property (aging deterioration).

According to the present inventors, it is conceivable that the aging deterioration is caused by the following mechanism. Hereinafter, the mechanism will be explained in detail with reference to FIG. 1A.

First, by performing press forming, strain is applied to the steel sheet to introduce the dislocation being a linear defect into the steel sheet. However, there is sometimes a case that the portion where the distribution of the strain applied by the press forming (prestrain) becomes non-uniform and further the prestrain becomes less than 1% occurs. In that case, the amount of the dislocation is not secured sufficiently, and further the dislocation is distributed non-uniformly. Consequently, in the portion where no dislocation is distributed, the solid solution C and the solid solution N precipitate as iron carbides and iron nitrides after baking finish. These iron carbides and iron nitrides themselves exist finely immediately after the baking finish treatment, so that the strength increases temporarily, but thereafter, as time passes, the carbides and nitrides grow and the progress of coarsening continues. As the coarsening continues, a dispersion strengthening capability decreases, and thus as shown in FIG. 1A, the yield strength begins to decrease gradually and the denting property deteriorates. On the other hand, when a certain value or more of the dislocation exists in the material steel sheet, even though time passes after forming and baking finish, the coarsening of the carbides and nitrides is suppressed and the deterioration of the denting property caused by the decrease in the yield strength is suppressed.

Such an aging deterioration problem after baking finish can be prevented if the forming amount at the time of press forming is increased and thereby the sufficient strain is applied to the steel sheet to secure the dislocation density. However, the press forming amount has a limit because in an outer sheet panel or the like of an automobile, its forming shape is determined in advance. For this reason, it is difficult to secure the dislocation density and further to distribute the dislocation uniformly with respect to the whole steel sheet.

Thus, the present invention has been made in consideration of the above-described circumstances, and has an object to provide a strain aging hardening type steel sheet that achieves a natural non-aging property and bake hardenability and is excellent in aging resistance after baking finish.

Means for Solving the Problems

The present inventors have obtained the knowledge that by performing temper rolling under an appropriate condition at the final stage of a producing process of the steel sheet before a press forming process, the steel sheet in which the dislocation density is secured and further the dislocation is distributed uniformly can be obtained, resulting in that the aging resistance after baking finish is improved. The present invention is devised based on such knowledge.

According to the present invention, there is provided a strain aging hardening type steel sheet excellent in aging resistance after baking finish containing: in mass %, C: 0.0010 to 0.010%; Si: 0.005 to 1.0%; Mn: 0.08 to 1.0%; P: 0.003 to 0.10%; S: 0.0005 to 0.020%; Al: 0.010 to 0.10%; Cr: 0.005 to 0.20%; Mo: 0.005 to 0.20%; Ti: 0.002 to 0.10%; Nb: 0.002 to 0.10%; N: 0.001 to 0.005%; and a balance being composed of Fe and inevitable impurities, in which a ferrite fraction is 98% or more, an average grain diameter of ferrite is 5 to 30 μm, a minimum value of dislocation density in a portion having a ½ thickness of a sheet thickness and a minimum value of dislocation density in a surface layer portion are each $5\times10^{12}/m^2$ or more, and an average dislocation density falls within a range of $5\times10^{12}$ to $1\times10^{15}/m^2$.

The steel sheet of the present invention may also further contain, in mass %, B: 0.005% or less. Further the steel sheet may also further contain 0.3 mass % or less of one type or two types or more selected from Cu, Ni, Sn, W, and V in total. Further, the steel sheet may also further contain 0.02 mass % or less of one type or two types or more selected from Ca, Mg, and REM in total. Further, a plated layer may also be provided on at least one front surface.

Further, according to the present invention, there is provided a manufacturing method of a strain aging hardening type steel sheet excellent in aging resistance after baking finish including: hot rolling a steel slab containing: in mass %, C: 0.0010 to 0.010%; Si: 0.005 to 1.0%; Mn: 0.08 to 1.0%; P: 0.003 to 0.10%; S: 0.0005 to 0.020%; Al: 0.010 to 0.10%; Cr: 0.005 to 0.20%; Mo: 0.005 to 0.20%; Ti: 0.002 to 0.10%; Nb: 0.002 to 0.10%; N: 0.001 to 0.005%; and a balance being composed of Fe and inevitable impurities; next performing cold rolling; then performing annealing at an annealing temperature falling within a range of 700 to 850° C.; performing cooling with an average cooling speed from 700 to 500° C. of 2° C./s or more; and performing temper rolling under a condition that a line load A is set to fall within a range of $1\times10^6$ to $2\times10^7$ N/m, tension B is set to fall within a range of $1\times10^7$ to $2\times10^8$ N/m$^2$, and the tension B/the line load A is set to fall within a range of 2 to 120, and further a reduction ratio is set to 0.2 to 2.0%.

In the manufacturing method of the present invention, the steel slab may also further contain, in mass %, B: 0.005 or less. Further, the steel slab may also further contain 0.3 mass % or less of one type or two types or more selected from Cu, Ni, Sn, W, and V in total. Further, the steel slab may also further contain 0.02 mass % or less of one type or two types or more selected from Ca, Mg, and REM in total. Further, before the temper rolling, a plated layer may also be provided on at least one front surface.

Effect of the Invention

According to the present invention, there is provided a strain aging hardening type steel sheet that achieves a natural non-aging property and bake hardenability and is further excellent in aging resistance after baking finish.

MODE FOR CARRYING OUT THE INVENTION

Figure 1A:
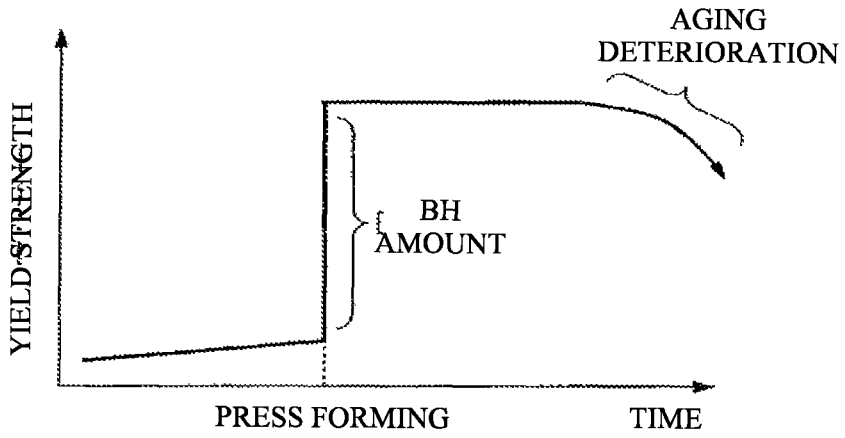
FIG. 1A and FIG. 1B each are a schematic graph for explaining a variation over time of yield strength in a conventional BH steel sheet.
Figure 1B:
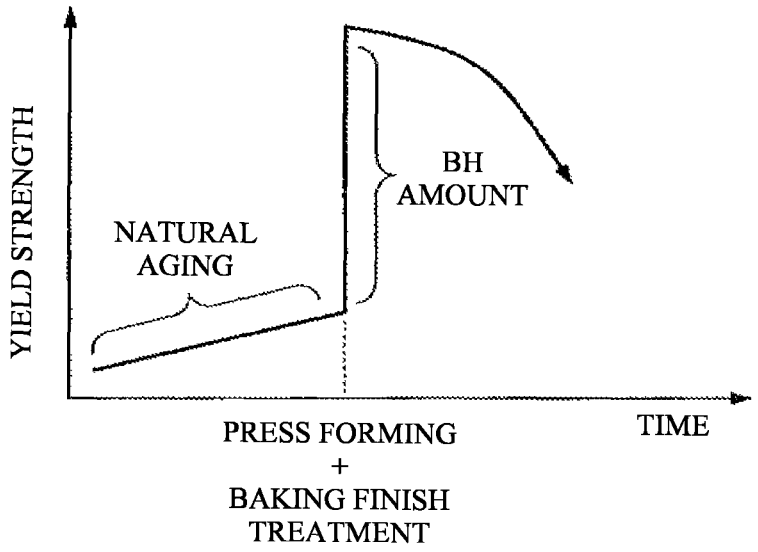

Hereinafter, a strain aging hardening type steel sheet excellent in aging resistance after baking finish of the present invention will be explained in detail.

The strain aging hardening type steel sheet excellent in aging resistance after baking finish of the present invention contains: in mass %, C: 0.0010 to 0.010%; Si: 0.005 to 1.0%; Mn: 0.08 to 1.0%; P: 0.003 to 0.10%; S: 0.0005 to 0.020%; Al: 0.010 to 0.10%; Cr: 0.005 to 0.20%; Mo: 0.005 to 0.20%; Ti: 0.002 to 0.10%; Nb: 0.002 to 0.10%; N: 0.001 to 0.005%; and a balance being composed of Fe and inevitable impurities, in which a ferrite fraction is 98% or more, an average grain diameter of ferrite is 5 to 30 μm, a minimum value of dislocation density in a portion having a ½ thickness of a sheet thickness and a minimum value of dislocation density in a surface layer portion are each $5\times10^{12}/m^2$ or more, and an average dislocation density falls within a range of $5\times10^{12}$ to $1\times10^{15}/m^2$.

Hereinafter, the reasons for limiting the compositions of the steel material of the present invention will be explained. Note that the notation of % means mass % unless otherwise noted.

(C: not less than 0.0010% nor more than 0.010%)

C is an element that affects strain aging hardenability, but when C is contained in excess of 0.010%, the natural non-aging property of the material cannot be secured. Further, C is an element that increases the strength of the steel sheet, and thus when the content of C is increased, the strength increases, but the workability at the time of press forming deteriorates to thus be unsuitable as a steel sheet for an automobile outer sheet. Further, for securing the natural non-aging property, the amounts of elements of Ti and Nb to be added are increased, and an increase in the strength due to precipitates is unavoidable and the workability deteriorates to thus be disadvantageous economically, so that the upper limit is set to 0.010%. Further, it is preferably C: 0.0085% or less, and is more preferably C: 0.007% or less.

Further, when the content of C is decreased, the bake hardenability is likely to decrease, and thus the lower limit is preferably 0.0010% or more. Further, it is more preferably C: 0.0012% or more, and is still more preferably C: 0.0015% or more.

(Si: not less than 0.005% nor more than 1.0%)

Si is an element useful for improving the strength of the steel sheet, but when Si is contained in large amounts, the strength increases too much to cause a risk of deteriorating the workability. Further, when galvanization is performed, zinc does not adhere to the steel sheet easily to further cause a risk of deteriorating the adhesiveness, and thus the upper limit is set to 1.0%. Further, it is preferably Si: 0.7% or less.

On the other hand, when the content of Si is decreased too much, an increase in cost at the steelmaking stage is caused, and furthermore the bake hardenability is likely to decrease, so that the lower limit is preferably 0.005% or more. Further, it is more preferably Si: 0.01% or more, and is still more preferably Si: 0.02% or more.

(Mn: not less than 0.08% nor more than 1.0%)

Mn is an element useful for improving the strength of the steel sheet, but when Mn is contained in large amounts, similarly to Si, the strength increases too much to cause a risk of deteriorating the workability. Further, when galvanization is performed, zinc does not adhere to the steel sheet easily to further cause a risk of deteriorating the adhesiveness, and thus the upper limit is set to 1.0%. Further, it is preferably Mn: 0.8% or less, and is more preferably Mn: 0.7% or less.

On the other hand, when the content of Mn is decreased too much, the bake hardenability is likely to decrease, so that the lower limit is preferably 0.08% or more. Further, it is more preferably Mn: 0.1% or more, and is still more preferably Mn: 0.2% or more.

(Al: not less than 0.010% nor more than 0.10%)

When the content of Al is increased too much, the strength increases too much, and the workability is likely to decrease remarkably. Furthermore, it becomes disadvantageous in terms of the cost, so that the upper limit is set to 0.1%. Further, it is preferably Al: 0.05% or less, and is more preferably Al: 0.04% or less.

Further, Al has an effect of fixing solid solution N as AlN to control the natural aging property of the steel sheet and a decrease in hardening amount after baking finish, but if Al is less than 0.01%, the natural non-aging property cannot be secured, and further the yield strength after forming and baking finish tends to decrease. Further, it is preferably Al: 0.02% or more, and is more preferably Al: 0.03% or more.

(Mo: not less than 0.005% nor more than 0.20%)

Mo is an element useful for improving the bake hardenability, and in the present invention, is an element useful for suppressing the coarsening (growth) of carbides and nitrides. As described previously, after baking finish, in the portion where no dislocation is distributed, the solid solution C and the solid solution N precipitate as carbides and nitrides. The above carbides and nitrides themselves are hard, so that the strength increases temporarily, but when the carbides and nitrides grow and the progress of coarsening continues, the yield strength decreases to cause the aging deterioration. Further, Mo is an element extremely effective for securing the natural non-aging property of the material. When the content of Mo is less than 0.005%, the effect of preventing the aging deterioration after baking finish cannot be obtained, and thus the lower limit is set to 0.005%. Further, it is preferably Mo: 0.03% or more, and is more preferably Mo: 0.05% or more.

On the other hand, when the content of Mo is too large, the strength increases too much to cause a risk of deteriorating the workability. Further, the bake hardenability also decreases to be expensive and disadvantageous economically, and thus the upper limit is set to 0.2%.

(N: not less than 0.001% nor more than 0.005%)

The reason why the content of N is set to 0.005% or less is because in the case of adding N in excess of 0.005%, unless the amount of Ti to be added is increased, it becomes difficult to secure the required natural non-aging property of the material. Further, it is because the decrease in the yield strength due to the aging after forming and baking finish cannot be suppressed, and further the strength increases to cause a risk of deteriorating the workability. Further, it is preferably N: 0.004% or less.

On the other hand, when the content of N is decreased, the bake hardenability is likely to decrease, and thus the lower limit is set to 0.001% or more. Further, it is preferably N: 0.002% or more.

(Cr: not less than 0.005% nor more than 0.20%)

Cr suppresses the coarsening of precipitates in the steel sheet during aging and further has a function of improving the natural non-aging property. However, Cr has an effect of decreasing the bake hardening amount, and when Cr is added too much, the strength further increases to cause a risk of deteriorating the workability, and thus the upper limit is set to 0.2%. Further, it is preferably Cr: 0.1% or less, and is more preferably Cr: 0.05% or less.

When the content of Cr is too small, these effects are small, and thus the lower limit is preferably 0.005% or more. Further, it is more preferably Cr: 0.01% or more, and is still more preferably Cr: 0.03% or more.

(Ti: not less than 0.002% nor more than 0.10%)

(Nb: not less than 0.002% nor more than 0.10%)

Both Ti and Nb are an element required for obtaining steel having good workability (or platability), which is called Nb—Ti—IF steel. However, when Ti and Nb are contained in large amounts, the BH amount decreases, and further the recrystallization temperature increases to cause a risk of deteriorating the workability, and thus the upper limits of Ti and Nb are set to 0.10%. Further, the content of Ti is preferably 0.08% or less, and is more preferably 0.01% or less. The content of Nb is preferably 0.07% or less, and is more preferably 0.05% or less.

Further, the reason why the lower limits of Ti and Nb are set to 0.002% is because if they are less than 0.002%, the ferrite grain diameter increases, and the non-uniformity of the dislocation density in the steel sheet after temper rolling increases, thus making it difficult to suppress the decrease in the yield strength after forming and baking finish. Further, it is because if they are less than 0.002%, it becomes difficult to fix the solid solution C and the solid solution N to secure the natural non-aging property of the material. Further, the content of Ti is preferably 0.003% or more. The content of Nb is preferably 0.003% or more, and is more preferably 0.005% or more.

(P: not less than 0.003% nor more than 0.10%)

P, similarly to Si and Mn, is an element useful for improving the strength of the steel sheet, but if P is contained in large amounts, the strength increases too much to cause a risk of deteriorating the workability. Further, when galvanization is performed, zinc does not adhere to the steel sheet easily to further cause a risk of deteriorating the adhesiveness. Further, P is an element of being concentrated in grain boundaries to easily cause grain boundary embrittlement, so that the upper limit is set to 0.10%. Further, it is preferably P: 0.06% or less, and is more preferably P: 0.04% or less.

Further, when the content of P is too small, an increase in cost at the steelmaking stage is caused, and furthermore the bake hardenability is likely to decrease, so that the lower limit is preferably 0.003% or more. Further, it is more preferably P: 0.01% or more, and is still more preferably P: 0.02% or more.

(S: not less than 0.0005% nor more than 0.020%)

Si is an element existing in the steel as an impurity, and further forms TiS to decrease effective Ti. Further, when S is added in excess of 0.02%, what is called hot shortness, in which at the time of hot rolling, red shortness is caused to cause crack in the front surface of the steel sheet, is likely to be caused, and thus S is preferably decreased as much as possible. Further, it is preferably S: 0.01% or less, and is more preferably S: 0.005% or less.

Further, when the content of S is too small, an increase in cost at the steelmaking stage is caused, and furthermore the bake hardenability is likely to decrease, so that the lower limit is preferably 0.0005% or more. Further, it is more preferably S: 0.002% or more.

Note that S and P are inevitable impurities, and are preferably decreased as much as possible.

Further, in the present invention, in addition to the above-described elements, B may also be added in a range of 0.005% or less.

The present inventors found out that B by itself is not sufficient to exhibit its effect, but B is compositely added with Mo described above, thereby making it possible to satisfy both the bake hardenability and the natural non-aging property.

Particularly, when C in excess of 0.006% is added, there is sometimes a case that a tendency for the natural non-aging property to deteriorate slightly is seen, but when B is added at this time, the natural non-aging property tends to improve. However, even though B is added too much, the effect of improving the natural non-aging property is saturated to thus become disadvantageous in terms of the cost. Further, the total elongation decreases and the performance of the steel material deteriorates, so that the upper limit is preferably set to 0.005%.

Further, the lower limit of B to be added is not limited in particular, but for improving the natural non-aging property and preventing the occurrence of the yield point elongation, the lower limit is preferably set to 0.0002%. Further, it is more preferably B: 0.0004% or more, and is still more preferably B: 0.0006% or more.

Further, in the present invention, in addition to the above-described elements, one type or two types or more selected from Cu, Ni, Sn, W, and V may also be added in a range of 0.3% or less in total content.

Cu, Ni, Sn, W, and V are elements each increasing the strength of the steel. However, when they are added too much, the workability is likely to deteriorate, and thus the upper limit of the total content of one type or two types or more selected from Cu, Ni, Sn, W, and V is preferably set to 0.3%. Further, the total content of one type or two types or more selected from Cu, Ni, Sn, W, and V is more preferably 0.15% or less.

Further, the lower limit of the total content of one type or two types or more selected from Cu, Ni, Sn, W, and V is not limited in particular, but for obtaining the effect of increasing the strength in a heat treatment, the lower limit is preferably 0.005% or more. Further, the total content of one type or two types or more selected from Cu, Ni, Sn, W, and V is more preferably 0.01% or more.

In the present invention, in addition to the above-described elements, one type or two types or more selected from Ca, Mg, and REM may also be added in a range of 0.02 mass % or less in total.

Ca, Mg, and REM are elements each effective for controlling the forms of oxide and sulfide, and each have an effect of improving the formability. The lower limits of the contents of these elements are not determined in particular, but for controlling the forms effectively, the content of Ca, the content of Mg, and the content of REM are preferably 0.0005% or more in total content. On the other hand, when the elements are added too much, the contents of oxide and sulfide become excessive to decrease the formability, and thus the content of Ca, the content of Mg, and the content of REM are preferably 0.02% or less in total content. Note that REM in the present invention indicates La and lanthanoid series elements.

Further, in the strain aging hardening type steel sheet in the present invention, the ferrite fraction is preferably 98% or more. The balance except ferrite consists of one type or two types of pearlite and bainite. When the ferrite fraction is less than 98% and pearlite or bainite increases, the workability decreases, and thus the ferrite fraction is preferably set to 98% or more.

Further, in the strain aging hardening type steel sheet in the present invention, the average grain diameter of ferrite preferably falls within a range of 5 to 30 p.m. As above, the ferrite grain diameter in the steel sheet is distributed minutely and uniformly, and thereby an effect of more uniformly dispersing the later-described dislocation is obtained.

However, when the average grain diameter of ferrite is less than 5 μm, the yield strength of the material increases, and thereby wrinkling called surface strain occurs after press forming and further the aging resistance after forming and baking finish decreases. On the other hand, the average grain diameter of ferrite exceeds 30 μm, the dislocation density in the portion having a ½ thickness of the sheet thickness cannot be secured sufficiently, and furthermore the non-uniformity of the dislocation density in the steel sheet increases and the aging resistance after forming and baking finish decreases. For this reason, the appropriate range of the average grain diameter of ferrite is preferably set to 5 to 30 μm.

Further, a lot of electron microscopic observation results made clear that the natural aging property, the bake hardenability, and further the aging resistance after baking finish vary greatly according to the dislocation distribution.

The present inventors conducted the electron microscopic observation of samples having the good natural aging property, bake hardenability, and aging resistance after baking finish. As a result, it was found out that in the case when the minimum value of dislocation density in the portion having a ½ thickness of the sheet thickness and the minimum value of dislocation density in the surface layer portion are each $5\times10^{12}/m^2$ or more and further the average dislocation density falls within a range of $5\times10^{12}$ to $1\times10^{15}/m^2$, the decrease over time in the denting property or the decrease in the yield strength after forming and baking finish, which has been the conventional problem, is suppressed. Further, it turned out that in the case of having the dislocation density falling within the above-described range, the press formability is excellent and further the certain bake hardening amount is obtained.

Hereinafter, the reasons for limiting the minimum value of the above-described dislocation density and the average dislocation density will be explained.

When the dislocation density in the portion having a ½ thickness of the sheet thickness and the surface layer portion is too small, the effect of suppressing the precipitation of carbides after baking finish cannot be obtained sufficiently to cause a risk that the decrease in the yield strength due to a variation over time, namely the deterioration of the denting property occurs, and thus the minimum value of dislocation density in the portion having a ½ thickness of the sheet thickness and the minimum value of dislocation density in the surface layer portion are each preferably set to $5\times10^{12}/m^2$ or more.

Further, when the average dislocation density is less than $5\times10^{12}/m^2$, not only the decrease in the yield strength due to a variation over time after baking finish, namely the deterioration of the denting property occurs, but also the natural non-aging property of the material tends to decrease. The cause of the decrease in the natural non-aging property of the material is not clarified, but it is conceivable because the dislocation density is small with respect to the solid solution C and thus mobile dislocation that relatively easily moves in the steel sheet is firmly fixed rapidly due to the natural aging.

Further, it became obvious that when the average dislocation density exceeds $1\times10^{15}/m^2$, not only the elongation of the steel sheet decreases and crack occurs at the time of press forming, but also the bake hardenability decreases. The cause of the above fact is not known, but is conceivable because the initial dislocation density before a baking finish treatment is high, thus making it impossible to firmly fix the mobile dislocation during the baking finish treatment.

Figure 3:
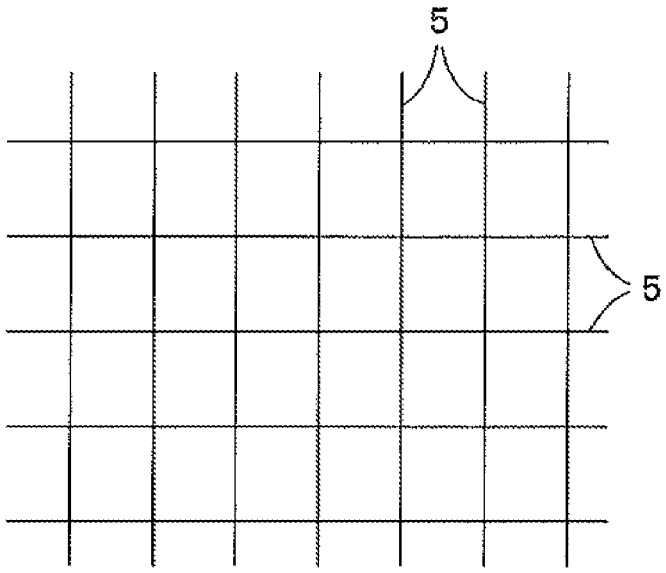
FIG. 3 is a view for explaining a way of obtaining dislocation density from a TEM photograph.

Incidentally, dislocation density ρ was measured in a manner that thin-film samples for a transmission electron microscope (TEM) are made by being cut out from a region located within 500 μm from the surface layer of the steel sheet and the portion having a ½ thickness of the steel sheet, and next are subjected to image observation by a transmission electron microscope to calculate the dislocation density by applying $\rho=2N/(Lt)$. Here, L denotes the total line length of parallel lines 5, 5 drawn on a TEM photograph and intersecting at right angles with each other as shown in FIG. 3, N denotes the number of these lines 5 intersecting with dislocation lines, and t denotes the thickness of the thin-film sample. The value of t may be obtained accurately, but generally, the value of 0.1 μm may also be used simply. Incidentally, the three thin-film samples from the region located within 500 μm from the surface layer of the steel sheet and the three thin-film samples from the portion having a ½ thickness of the steel sheet were each subjected to the image observation, and the portion having the lowest dislocation density in the observable regions of the three samples and the average dislocation density of the three samples were measured.

Further, in the strain aging hardening type steel sheet in the present invention, it is preferable for post-aging yield strength $\sigma_f$ after baking finish not to be decreased by 20 MPa or more as compared with yield strength $\sigma_s$ immediately after baking finish. That is, it is preferable to be $\sigma_f>\sigma_s-20$ MPa. Here, the post-aging yield strength $\sigma_f$ after baking finish and the yield strength $\sigma_s$ immediately after baking finish will be explained with reference to FIG. 2A and FIG. 2B.

Figure 2A:
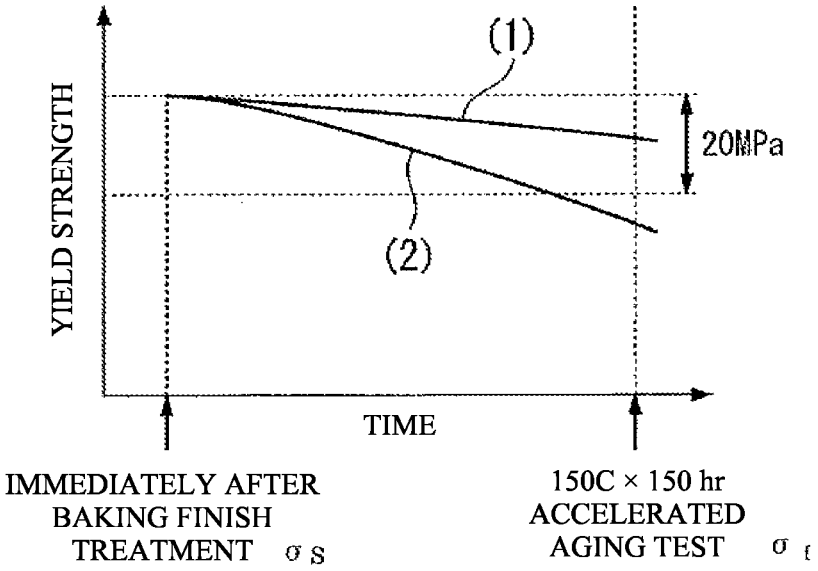
FIG. 2A and FIG. 2B each are a schematic graph for explaining a variation over time of yield strength in a strain aging hardening type steel sheet being an embodiment of the present invention.
Figure 2B:
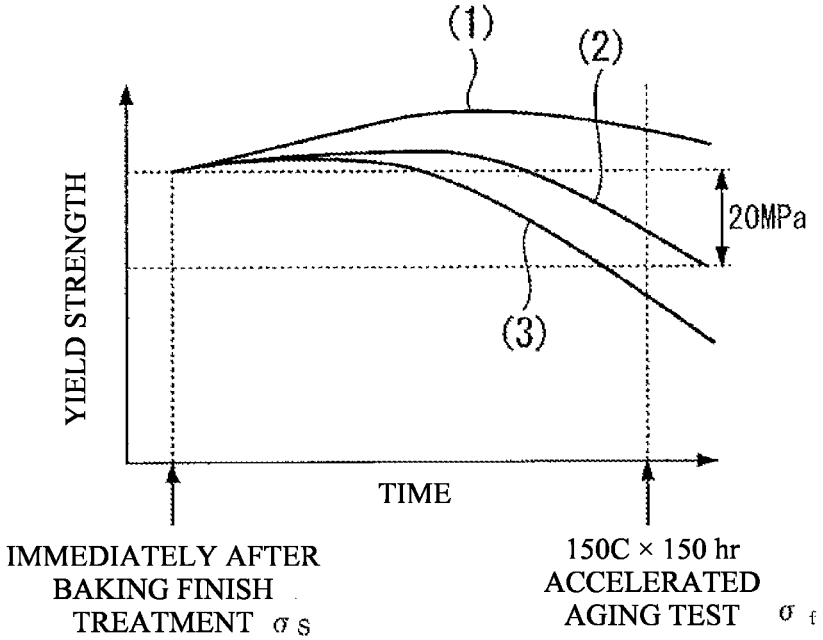

FIG. 2A and FIG. 2B are graphs each schematically showing a variation over time of the yield strength after the baking finish treatment of the strain aging hardening type steel sheet in the present invention.

As shown in FIG. 2A, the yield strength immediately after the baking finish treatment is set to $\sigma_s$, and the post-aging yield strength after an accelerated aging test (accelerated aging heat treatment) of 150° C.×150 hr is set to $\sigma_f$. Incidentally, the present inventors made clear that when the post-aging yield strength $\sigma_f$ falls below the yield strength $\sigma_s-20$ MPa (see the curve (2) in FIG. 2A), the denting property greatly decreases. For this reason, in this embodiment, the above post-aging yield strength $\sigma_f$ is preferably larger than the yield strength $\sigma_s-20$ MPa (see the curve (1) in FIG. 2A).

Here, the condition of the accelerated aging test is set so as to correspond to the actual usage environment of a product having the strain aging hardening type steel sheet according to the present invention used therein. In this embodiment, the heat treatment of 150° C.×150 hr that satisfies such a condition is set to the accelerated aging test.

Further, in this embodiment, as indicated by the curve (1) and the curve (2) in FIG. 2B, there is sometimes a case that the yield strength increases temporarily after the baking finish treatment. This conceivably occurs depending on the content of carbon of the steel sheet. However, even in such a case, the post-aging yield strength $\sigma_f$ is only necessary to be larger than the yield strength $\sigma_s-20$ MPa. It does not matter even though the yield strength increases temporarily after the baking finish treatment because the effect of the present invention is obtained.

However, even though the yield strength increases temporarily as above, as indicated by the curve (3) in FIG. 2B, if the post-aging yield strength $\sigma_f$ falls below the yield strength $\sigma_s-20$ MPa, it is not possible to say that the strain aging hardening type steel sheet satisfies this embodiment.

Furthermore, the strain aging hardening type steel sheet in the present invention can enjoy the effect of the invention in any one of a cold-rolled steel sheet, a hot-dip galvanized steel sheet, an alloyed hot-dip galvanized steel sheet, an electro-galvanized steel sheet, and various surface treated steel sheets. As a plated layer, any one of zinc, aluminum, tin, copper, nickel, chromium, and alloy plating based on these elements may be applied, and an element other than the above-described elements may also be contained. Further, when a zinc-containing layer is provided on at least one surface of these steel sheets, oxidation and decarburization during warm forming (for example, warm press forming) are prevented to make it possible to enjoy the effect of the present invention more effectively.

Incidentally, the zinc-containing layer on at least one front surface may also be provided by any method such as an electroplating method, a hot dipping method, a coating method, or a vapor deposition method, and the method is not limited. Further, it is also acceptable that an element other than zinc is contained in the zinc-containing layer.

Further, it is more preferable that the steel sheet of the present invention should be a cold-rolled steel sheet allowing the minute crystal grain diameter as described above to be obtained relatively easily.

Next, a manufacturing method of the strain aging hardening type steel sheet excellent in aging resistance after baking finish of the present invention will be explained. Note that the strain aging hardening type steel sheet of the present invention is not limited to one manufactured by the following manufacturing method.

In the manufacturing method of the present invention, before temper rolling being the final stage of the producing process of the steel sheet, annealing is performed at an annealing temperature falling within a range of 700 to 850° C., and next cooling with an average cooling speed from 700 to 500° C. of 2° C./s or more is performed. Thereafter, the temper rolling is performed under the condition that when a line load by a reduction roll in the temper rolling is set to A (N/m) and tension applied to the steel sheet at the time of temper rolling is set to B ($N/m^2$), the line load A satisfies $1\times10^6$ to $2\times10^7$ N/m, the tension B satisfies $1\times10^7$ to $2\times10^8$ $N/m^2$, and the tension B/the line load A satisfies 2 to 120, and the reduction ratio is 0.2 to 2.0%.

Hereinafter, the reasons for limiting the above-described manufacturing condition will be explained.

First, the molten steel adjusted to have the above-described compositions is made into a cast slab or a steel slab by a continuous casting method, or a steel slab by an ingot-making method, and the cast slab or the steel slab is subjected to hot rolling at high temperature without being heated, or is subjected to hot rolling after being heated.

Further, for enjoying the effect of the present invention more effectively, it is preferable that a steel sheet after being hot rolled should be subjected to a descaling treatment after the hot rolling to be cold rolled to thereby make a cold-rolled steel sheet.

Furthermore, it is also possible to perform annealing thereafter to thereby make a cold-rolled steel sheet, but it is more preferable that galvanization should be performed on at least one front surface of the cold-rolled steel sheet after the annealing to thereby form a zinc-containing layer to make a hot-dip galvanized steel sheet, an alloyed hot-dip galvanized steel sheet, or an electrogalvanized steel sheet.

Incidentally, the zinc-containing layer may also be formed by any method such as an electroplating method, a hot dipping method, a coating method, or a vapor deposition method, and the method is not limited.

Incidentally, in the present invention, the sheet thickness of the steel sheet is not limited, but it is particularly effective that the sheet thickness is 0.4 to 6 mm.

Further, the annealing in the present invention is preferably performed at the annealing temperature falling within a range of 700 to 850° C. and at the average cooling speed from 700 to 500° C. of 2° C./s or more. This is because if the annealing temperature falls outside the above range, there is a risk that it becomes impossible to control the solid solution C and the solid solution N to the appropriate contents or it becomes difficult to make Mo having a function of suppressing the precipitation of carbides after baking finish exist in the crystal grains. Further, if the annealing temperature is too high, the crystal grain diameter is likely to be coarse, and thus the annealing temperature and the average cooling speed preferably fall within the above-described ranges.

Further, for obtaining the appropriate crystal grain diameter in the present invention, a maintaining time within the above-described range of the annealing temperature is preferably set to 20 to 280 seconds.

Next, the cold-rolled steel sheet, the hot-dip galvanized steel sheet, or the alloyed hot-dip galvanized steel sheet is made, and then is subjected to the temper rolling.

In the present invention, the condition of the temper rolling is set that when the line load at the time of temper rolling is set to A (N/m) and the tension applied to the steel sheet at the time of temper rolling is set to B ($N/m^2$), A satisfies $1\times10^6$ to $2\times10^7$ N/m, B satisfies $1\times10^7$ to $2\times10^8$ $N/m^2$, and B/A satisfies 2 to 120, and the reduction ratio is preferably set to 0.2 to 2.0%.

When the line load A is less than $1\times10^6$ N/m, the introduction amount of the dislocation into the steel sheet is small, the decrease in the yield strength due to a variation over time, namely the deterioration of the denting property occurs, and the natural non-aging property of the material tends to decrease.

Further, when the line load A exceeds $2\times10^7$/m, the average dislocation density increases, and thus not only the elongation of the steel sheet decreases to cause crack at the time of press forming, but also the bake hardenability is likely to decrease.

When the tension B is less than $1\times10^7$ $N/m^2$, the shape of the steel sheet is poor, and when the steel sheet is used as an outer sheet for an automobile, for example, the steel sheet sometimes becomes unsuitable.

Further, when the tension B exceeds $2\times10^8$ $N/m^2$, sheet fracture is likely to occur, which is unsuitable productively.

Here, B/A is the most important parameter in the present invention that affects the uniformity of the dislocation density in the steel sheet. When B/A is less than 2, the dislocation is not introduced into the center portion of the sheet thickness, and the decrease in the yield strength due to a variation over time after forming and baking finish, namely the deterioration of the denting property occurs. On the other hand, even though B/A exceeds 120, there is sometimes a case that the introduction of the dislocation into the center portion of the sheet thickness is insufficient, and further there is also sometimes a case that the non-uniformity of the dislocation density in the surface of the steel sheet increases, resulting in that the decrease in the yield strength due to a variation over time after forming and baking finish, namely the deterioration of the denting property occurs.

Further, when the reduction ratio of the temper rolling is less than 0.2%, the introduction amount of the dislocation into the steel sheet becomes insufficient, the natural non-aging property of the material decreases, and the non-uniformity of the dislocation density after forming increases. For this reason, the decrease in the yield strength due to a variation over time after baking finish, namely the deterioration of the denting property is likely to occur.

On the other hand, when the reduction ratio of the temper rolling exceeds 2.0%, the ductility of the steel sheet deteriorates to decrease the formability, and the bake hardening amount is likely to decrease.

By setting the condition of the temper rolling as above, the uniform and sufficient strain amount can be applied to the steel sheet. Consequently, the dislocation density allowing the bake hardenability to be obtained sufficiently can be secured, and further the dislocation can be distributed uniformly. For this reason, it is possible to suppress the precipitations of carbides and nitrides that are the cause of the aging deterioration after baking finish.

Next, after the temper rolling, process forming, namely press forming such as drawing, for example, is performed. The method of press forming is not defined in particular, and it is also acceptable to add drawing, bulging, bending, ironing, punching, and so on.

According to the strain aging hardening type steel sheet according to the present invention, which has been explained above, the above-described compositions and formation make it possible to apply the sufficient strain amount at the stage before press forming. Consequently, the sufficient dislocation density can be secured, so that it is possible to fix the solid solution C and the solid solution N to the dislocation stably. This makes it possible to sufficiently obtain the bake hardenability.

Further, it is possible to improve the bake hardening amount with 2% of prestrain to be 30 MPa or more.

Further, to the strain aging hardening type steel sheet according to the present invention, the strain is uniformly applied by the temper rolling, so that the uniformity of the dislocation distribution can be improved. Consequently, the portion into which the dislocation is not introduced can be decreased, and the precipitations of carbides and nitrides, which have been the cause of the aging deterioration after baking finish, can be suppressed. Consequently, the post-aging yield strength after baking finish can be set larger than the yield strength immediately after baking finish −20 MPa. That is, the decreased amount of the yield strength due to the aging after baking finish can be suppressed greatly, and further the deterioration of the denting property can be prevented.

Further, according to the strain aging hardening type steel sheet according to the present invention, the natural non-aging property can be obtained, so that the press formability can be improved.

Further, according to the manufacturing method of the strain aging hardening type steel sheet according to the present invention, the annealing is performed under the annealing condition as described above, and thereby it is possible to make Mo exist in the crystal grains in solution. Mo existing in the grains functions to suppress the precipitation of carbides after baking finish, so that aging deterioration resistance after baking finish can be further improved consequently. Furthermore, it is also possible to control the solid solution C and the solid solution N in the steel sheet to the appropriate amounts, resulting in that the bake hardenability and the aging deterioration resistance can be improved.

Further, even though carbides and nitrides precipitate, the coarsening of carbides and nitrides can be suppressed because Mo is added. This makes it possible to prevent the decrease in the yield strength caused due to the coarsening of carbides and nitrides and the decrease in the denting property.

Further, the ferrite grain diameter in the steel sheet is distributed minutely, thereby making it possible to distribute the dislocation more uniformly.

EXAMPLE

Hereinafter, the effect of the present invention will be explained in examples, but the present invention is not limited to the conditions used in the following examples.

In the present examples, first, steels having compositions shown in Table 1 and Table 2 were each melted to make a slab by continuous casting according to an ordinary method. Next, each of the slabs was heated up to 1200° C. in a heating furnace, and was subjected to hot rolling at a finishing temperature of 900° C. to be wound up at a temperature of 700° C., and then was subjected to acid pickling to make a hot-rolled steel sheet.

Next, each of the hot-rolled steel sheets was subjected to cold rolling at the reduction ratio of 80%, and then was subjected to recrystallization annealing under the conditions shown in Table 3 and Table 4. Further, the sheet thicknesses of the steel sheets obtained at this time are shown in Table 3 and Table 4.

Next, plating was performed on front surfaces of some of the steel sheets under the conditions shown in Table 3 and Table 4 to provide a zinc-containing layer on surface layers of the steel sheets.

Next, the steel sheets each having had the plating performed thereon were used to be subjected to temper rolling, and cold-rolled steel sheets each having the ferrite average grain diameter, the minimum dislocation density, and the average dislocation density shown in Table 5 and Table 6 were made. Further, the respective conditions of the line load A, the tension B, and the reduction ratio are shown in Table 3 and Table 4.

Next, an evaluation test of the natural non-aging property was performed. Concretely, as the accelerated aging condition, a heat treatment of 100° C.×60 minutes was performed, and then a JIS 5 test piece was made from each of the cold-rolled steel sheets obtained by the above-described manufacturing method. With the above test pieces, a tension test was performed to measure the amount of the yield point elongation (YPEL). The results are shown in Table 5 and Table 6. Incidentally, when the YPEL amount exceeds 0.5%, a pattern defect called stretcher strain appears during press forming performed after the temper rolling to be unsuitable as an outer sheet panel, and thus the steel sheets each having the YPEL amount in excess of 0.5% were judged as NG (no good).

Next, the BH amount was measured to thereby perform an evaluation test of the bake hardenability. First, a JIS 5 test piece was made from each of the cold-rolled steel sheets obtained by the above-described manufacturing method to have 2% of tensile prestrain applied thereto, and then was subjected to a heat treatment corresponding to baking finish under the maintaining condition of 170° C.×20 min to measure the bake hardening amount (BH amount). The above results are shown in Table 5 and Table 6. Incidentally, in the present evaluation, the test pieces each having the bake hardening amount (BH amount) being less than 30 MPa determined as a required BH amount of a bake hardening type steel sheet in The Japan Iron and Steel Federation standard were judged as NG.

Next, an evaluation test of the aging resistance was performed. Concretely, the evaluation test of the aging resistance was performed in a manner to measure a variation over time of the yield strength related to the denting property between before and after the baking finish treatment. Concretely, the test piece obtained after the above-described heat treatment was subjected to the accelerated aging test corresponding to the actual usage environment of a product (for example, an automobile, or the like) having the strain aging hardening type steel sheet according to the present invention used therein to measure the variation of the yield strength during the aging.

First, as the test piece, a JIS 5 test piece was used to have 2% of tensile prestrain applied thereto, and then was subjected to a heat treatment corresponding to baking finish of 170° C.×20 min. Next, as the accelerated aging test, a heat treatment was performed under the condition of 150° C.×150 hours, and then the yield strength after the accelerated aging was measured by the tension test to measure the decreased amount of the yield strength between before and after the accelerated aging test. Incidentally, in the method of evaluating the aging resistance, when the above decreased amount (the yield strength before the accelerated aging—the yield strength after the accelerated aging) exceeds 20 MPa, the denting property decreases greatly, and thus the test pieces each having the decreased amount in excess of 20 MPa were judged as NG.

The foregoing evaluation results are shown in Table 5 and Table 6.

[Table 1]

[Table 2]

[Table 3]

[Table 4]

[Table 5]

[Table 6]

As shown in Table 5 and Table 6, it was possible to obtain the good result in terms of each of the natural non-aging property, the bake hardenability, and the aging resistance in all the present invention examples each falling within the range of the present invention.

On the other hand, in Experimental Example 2, the annealing temperature was in excess of the range in the present invention, and thus the crystal grain diameter became coarse, resulting in that the sufficient dislocation density was unable to be obtained in the portion having a ½ thickness of the sheet thickness. Further, in Experimental Example 3, the sufficient bake hardenability and aging resistance were unable to be obtained. This is conceivably because the annealing temperature was lower than the range in the present invention, thereby making it impossible to sufficiently secure the solid solution C and the solid solution N, and further making it impossible to make Mo exist in the crystal grains sufficiently.

In Experimental Example 4, the average cooling speed was too slow, so that, similarly to Experimental Example 3, the sufficient bake hardenability and aging resistance were unable to be obtained.

In Experimental Examples 6, 12, and 37, the line load A was too small, thereby making it impossible to obtain the sufficient dislocation density, and consequently, Experimental Examples 6, 12, and 37 were unable to be satisfied with the aging resistance in particular. Further, in Experimental Examples 7 and 38, the line load A was too large, so that the average dislocation density increased significantly to make it impossible to obtain the sufficient bake hardenability.

Further, in Experimental Example 8, the tension B was too small, so that the value of B/A decreased consequently, and the dislocation was not introduced into the center portion of the steel sheet, thereby making it impossible to obtain the sufficient aging resistance.

Incidentally, in Experimental Example 9, the satisfactory results were obtained in terms of all the natural non-aging property, bake hardenability, and aging resistance, but the value of the tension B was too large, and thus the steel sheet fractured at the time of threading.

In Experimental Examples 10 and 11, the line load A and the tension B each fell within the range in the present invention, but the value of B/A fell outside the range in the present invention. Consequently, in both Experimental Examples 10 and 11, the dislocation was not introduced into the center portion of the steel sheet, thereby making it impossible to obtain the sufficient aging resistance.

In Experimental Example 13, the value of B/A fell within the range, but the line load A was too large, and thus the sufficient bake hardenability was unable to be obtained.

In Experimental Example 18, the reduction ratio was too low, so that the sufficient dislocation was not introduced into the steel sheet and further the non-uniformity of the dislocation distribution increased. Consequently, YPEL increased significantly, and further the sufficient aging resistance was unable to be obtained.

Further, in Experimental Example 21, the reduction ratio was too high, so that the average dislocation density increased significantly to make it impossible to obtain the sufficient bake hardenability.

In Experimental Example 25, the maintaining time in the annealing was too long, so that the crystal grain diameter became coarse, thus making it impossible to obtain the sufficient dislocation density in the portion having a ½ thickness of the sheet thickness. Further, in Experimental Example 26, the annealing temperature was low and further the maintaining time was also short, and thus the crystal grain diameter was unable to grow to fall within the range of the present invention, and consequently the sufficient natural non-aging property and aging resistance were unable to be obtained.

In Experimental Examples 40 to 43, 45, and 46, the content of Mo was less than the range of the present invention, and thus YPEL increased significantly and the decreased amount of the yield strength after the baking treatment also increased. This is conceivable that Mo being effective for suppressing the growth of carbides and nitrides was small, and thus carbides and nitrides grew after baking finish to cause the aging deterioration. Further, it is conceivable that Mo is the element effective for securing the natural non-aging property, but the content of Mo was insufficient and thus YPEL increased significantly.

Further, it is conceivable that the increase in YPEL in Experimental Examples 40 to 42, and 45 results also from the fact that the contents of Si, Mn, P, and Al being the elements effective for improving the strength of the steel sheet were the contents in excess of the ranges of the present invention.

Further, the increase in YPEL in Experimental Example 43 is conceivably caused because the content of S was large, and thus the solid solution C and the solid solution N were fixed and Ti effective for securing the natural non-aging property was decreased.

In Experimental Example 44, it is conceivable that the content of Al having the effect of fixing the solid solution N as AlN and suppressing the natural aging property was too small, and thus YPEL increased.

In Experimental Example 47, it is conceivable that the content of Mo increased too much, and thus the strength became too high and consequently, the bake hardenability decreased.

The content of Ti was too small in Experimental Example 48, and the content of Nb was too small in Experimental Example 50, and thus in Experimental Examples 48 and 50, the crystal grain diameter became coarse to make it impossible to secure the sufficient dislocation density. Consequently, it is conceivable that the aging resistance after baking finish was unable to be secured. Further, the increase in YPEL is conceivably caused because the contents of Ti and Nb being the elements effective for securing the natural non-aging property were too small.

Further, it is conceivable that the content of Ti was too large in Experimental Example 49 and the content of Nb was too large in Experimental Example 51, and thus in Experimental Examples 49 and 51, the bake hardenability decreased.

In Experimental Example 52, it is conceivable that the content of N was too large with respect to the content of Ti, and thus YPEL increased.

In Experimental Example 53, YPEL increased. This is conceivably because the content of Cr being the element effective for securing the natural non-aging property was insufficient.

On the other hand, in Experimental Example 54, the bake hardenability decreased, and this is conceivably because the content of Cr was too large.

In Experimental Example 55, YPEL increased and the decreased amount of the yield strength after the baking treatment also increased. This is conceivably because the content of Mo was too small. Further, in Experimental Example 55, it is conceivable that the total content of Cu, Ni and Sn was also much larger than the range of the present invention, and thus the strength increased, and this also caused the increase in YPEL.

In Experimental Example 56, YPEL increased and the decreased amount of the yield strength after the baking treatment also increased. The decrease in the yield strength is conceivably caused because the content of Mo was too small, and the increase in YPEL is conceivably caused because the content of B was too large.

In Experimental Example 57, it is conceivable that the content of C was too large, and thus YPEL increased significantly and the natural non-aging property decreased. Further, the reason why the decreased amount of the yield strength after the baking treatment increased is conceivably because the content of C was too large, and thus after baking finish, carbides to precipitate increased and further the carbides grew.

Further, in Experimental Example 58, YPEL increased and further the decreased amount of the yield strength after the baking treatment increased significantly. This is conceivably because similarly to Experimental Example 57, the content of C was increased significantly. Further, it is conceivable that this results also from the fact that the content of Mn being the element useful for improving the strength was increased too much.

In Experimental Example 59 to Experimental Example 62, the bake hardenability decreased in all the cases. This is conceivably because the contents of C, Si, Mn, and N effective for securing the bake hardenability were too small.

These results made it possible to confirm the above-described knowledge, and further to substantiate the reasons for limiting the above-described respective steel compositions.

INDUSTRIAL APPLICABILITY

The present invention is useful for a steel sheet for an outer sheet used in a side panel, a hood, or the like of an automobile.

TABLE 1

| | CHEMICAL COMPOSITION (mass %) | | | | | | | | | | | |
|---|---|---|---|---|---|---|---|---|---|---|---|---|
| | C | Si | Mn | P | S | Al | Mo | Ti | Nb | N | Cr | Cu |
| EXPERIMENTAL EXAMPLE 1 | 0.0015 | 0.02 | 0.1 | 0.01 | 0.003 | 0.03 | 0.10 | 0.01 | 0.005 | 0.002 | 0.02 | 0.01 |
| EXPERIMENTAL EXAMPLE 2 | 0.0015 | 0.02 | 0.1 | 0.01 | 0.003 | 0.03 | 0.1 | 0.01 | 0.005 | 0.002 | 0.02 | 0.01 |
| EXPERIMENTAL EXAMPLE 3 | 0.0015 | 0.02 | 0.1 | 0.01 | 0.003 | 0.03 | 0.1 | 0.01 | 0.005 | 0.002 | 0.02 | 0.01 |
| EXPERIMENTAL EXAMPLE 4 | 0.0015 | 0.02 | 0.1 | 0.01 | 0.003 | 0.03 | 0.1 | 0.01 | 0.005 | 0.002 | 0.02 | 0.01 |
| EXPERIMENTAL EXAMPLE 5 | 0.0015 | 0.02 | 0.1 | 0.01 | 0.003 | 0.03 | 0.1 | 0.01 | 0.005 | 0.002 | 0.02 | 0.01 |
| EXPERIMENTAL EXAMPLE 6 | 0.0015 | 0.02 | 0.1 | 0.01 | 0.003 | 0.03 | 0.1 | 0.01 | 0.005 | 0.002 | 0.02 | 0.01 |
| EXPERIMENTAL EXAMPLE 7 | 0.0015 | 0.02 | 0.1 | 0.01 | 0.003 | 0.03 | 0.1 | 0.01 | 0.005 | 0.002 | 0.02 | 0.01 |
| EXPERIMENTAL EXAMPLE 8 | 0.0015 | 0.02 | 0.1 | 0.01 | 0.003 | 0.03 | 0.1 | 0.01 | 0.005 | 0.002 | 0.02 | 0.01 |
| EXPERIMENTAL EXAMPLE 9 | 0.0015 | 0.02 | 0.1 | 0.01 | 0.003 | 0.03 | 0.1 | 0.01 | 0.005 | 0.002 | 0.02 | 0.01 |
| EXPERIMENTAL EXAMPLE 10 | 0.0015 | 0.02 | 0.1 | 0.01 | 0.003 | 0.03 | 0.1 | 0.01 | 0.005 | 0.002 | 0.02 | 0.01 |
| EXPERIMENTAL EXAMPLE 11 | 0.0015 | 0.02 | 0.1 | 0.01 | 0.003 | 0.03 | 0.1 | 0.01 | 0.005 | 0.002 | 0.02 | 0.01 |
| EXPERIMENTAL EXAMPLE 12 | 0.0015 | 0.02 | 0.1 | 0.01 | 0.003 | 0.03 | 0.1 | 0.01 | 0.005 | 0.002 | 0.02 | 0.01 |
| EXPERIMENTAL EXAMPLE 13 | 0.0015 | 0.02 | 0.1 | 0.01 | 0.003 | 0.03 | 0.1 | 0.01 | 0.005 | 0.002 | 0.02 | 0.01 |
| EXPERIMENTAL EXAMPLE 14 | 0.0015 | 0.02 | 0.1 | 0.01 | 0.003 | 0.03 | 0.1 | 0.01 | 0.005 | 0.002 | 0.02 | 0.01 |
| EXPERIMENTAL EXAMPLE 15 | 0.0015 | 0.02 | 0.1 | 0.01 | 0.003 | 0.03 | 0.1 | 0.01 | 0.005 | 0.002 | 0.02 | 0.01 |
| EXPERIMENTAL EXAMPLE 16 | 0.0015 | 0.02 | 0.1 | 0.01 | 0.003 | 0.03 | 0.1 | 0.01 | 0.005 | 0.002 | 0.02 | 0.01 |
| EXPERIMENTAL EXAMPLE 17 | 0.0015 | 0.02 | 0.1 | 0.01 | 0.003 | 0.03 | 0.1 | 0.01 | 0.005 | 0.002 | 0.02 | 0.01 |
| EXPERIMENTAL EXAMPLE 18 | 0.0015 | 0.02 | 0.1 | 0.01 | 0.003 | 0.03 | 0.1 | 0.01 | 0.005 | 0.002 | 0.02 | 0.01 |
| EXPERIMENTAL EXAMPLE 19 | 0.0015 | 0.02 | 0.1 | 0.01 | 0.003 | 0.03 | 0.1 | 0.01 | 0.005 | 0.002 | 0.02 | 0.01 |
| EXPERIMENTAL EXAMPLE 20 | 0.0015 | 0.02 | 0.1 | 0.01 | 0.003 | 0.03 | 0.1 | 0.01 | 0.005 | 0.002 | 0.02 | 0.01 |
| EXPERIMENTAL EXAMPLE 21 | 0.0015 | 0.02 | 0.1 | 0.01 | 0.003 | 0.03 | 0.1 | 0.01 | 0.005 | 0.002 | 0.02 | 0.01 |
| EXPERIMENTAL EXAMPLE 22 | 0.0015 | 0.02 | 0.1 | 0.01 | 0.003 | 0.03 | 0.1 | 0.01 | 0.005 | 0.002 | 0.02 | 0.01 |
| EXPERIMENTAL EXAMPLE 23 | 0.0015 | 0.02 | 0.1 | 0.01 | 0.003 | 0.03 | 0.1 | 0.01 | 0.005 | 0.002 | 0.02 | 0.01 |
| EXPERIMENTAL EXAMPLE 24 | 0.0012 | 0.1 | 0.08 | 0.02 | 0.004 | 0.04 | 0.12 | 0.006 | 0.005 | 0.002 | 0.04 | — |
| EXPERIMENTAL EXAMPLE 25 | 0.0012 | 0.1 | 0.08 | 0.02 | 0.004 | 0.04 | 0.12 | 0.006 | 0.005 | 0.002 | 0.04 | — |
| EXPERIMENTAL EXAMPLE 26 | 0.0012 | 0.1 | 0.08 | 0.02 | 0.004 | 0.04 | 0.12 | 0.006 | 0.005 | 0.002 | 0.04 | — |
| EXPERIMENTAL EXAMPLE 27 | 0.0018 | 0.02 | 0.5 | 0.03 | 0.003 | 0.03 | 0.05 | 0.005 | 0.005 | 0.003 | 0.02 | — |
| EXPERIMENTAL EXAMPLE 28 | 0.0020 | 0.01 | 0.6 | 0.04 | 0.004 | 0.03 | 0.04 | 0.008 | 0.005 | 0.002 | 0.04 | 0.02 |
| EXPERIMENTAL EXAMPLE 29 | 0.0030 | 0.02 | 0.8 | 0.03 | 0.005 | 0.04 | 0.20 | 0.009 | 0.008 | 0.002 | 0.04 | 0.01 |
| EXPERIMENTAL EXAMPLE 30 | 0.0055 | 0.7 | 0.5 | 0.03 | 0.003 | 0.04 | 0.15 | 0.025 | 0.007 | 0.002 | 0.03 | — |

| | CHEMICAL COMPOSITION (mass %) | | | | | | |
|---|---|---|---|---|---|---|---|
| | Ni | Sn | W | V | B | OTHERS | NOTE |
| EXPERIMENTAL EXAMPLE 1 | — | — | — | — | — | — | PRESENT INVENTION EXAMPLE |
| EXPERIMENTAL EXAMPLE 2 | — | — | — | — | — | — | COMPARATIVE EXAMPLE |
| EXPERIMENTAL EXAMPLE 3 | — | — | — | — | — | — | COMPARATIVE EXAMPLE |
| EXPERIMENTAL EXAMPLE 4 | — | — | — | — | — | — | COMPARATIVE EXAMPLE |
| EXPERIMENTAL EXAMPLE 5 | — | — | — | — | — | — | PRESENT INVENTION EXAMPLE |
| EXPERIMENTAL EXAMPLE 6 | — | — | — | — | — | — | COMPARATIVE EXAMPLE |
| EXPERIMENTAL EXAMPLE 7 | — | — | — | — | — | — | COMPARATIVE EXAMPLE |
| EXPERIMENTAL EXAMPLE 8 | — | — | — | — | — | — | COMPARATIVE EXAMPLE |
| EXPERIMENTAL EXAMPLE 9 | — | — | — | — | — | — | PRESENT INVENTION EXAMPLE |
| EXPERIMENTAL EXAMPLE 10 | — | — | — | — | — | — | COMPARATIVE EXAMPLE |
| EXPERIMENTAL EXAMPLE 11 | — | — | — | — | — | — | COMPARATIVE EXAMPLE |
| EXPERIMENTAL EXAMPLE 12 | — | — | — | — | — | — | COMPARATIVE EXAMPLE |
| EXPERIMENTAL EXAMPLE 13 | — | — | — | — | — | — | COMPARATIVE EXAMPLE |
| EXPERIMENTAL EXAMPLE 14 | — | — | — | — | — | — | PRESENT INVENTION EXAMPLE |
| EXPERIMENTAL EXAMPLE 15 | — | — | — | — | — | — | PRESENT INVENTION EXAMPLE |
| EXPERIMENTAL EXAMPLE 16 | — | — | — | — | — | — | PRESENT INVENTION EXAMPLE |
| EXPERIMENTAL EXAMPLE 17 | — | — | — | — | — | — | PRESENT INVENTION EXAMPLE |
| EXPERIMENTAL EXAMPLE 18 | — | — | — | — | — | — | COMPARATIVE EXAMPLE |
| EXPERIMENTAL EXAMPLE 19 | — | — | — | — | — | — | PRESENT INVENTION EXAMPLE |
| EXPERIMENTAL EXAMPLE 20 | — | — | — | — | — | — | PRESENT INVENTION EXAMPLE |
| EXPERIMENTAL EXAMPLE 21 | — | — | — | — | — | — | COMPARATIVE EXAMPLE |
| EXPERIMENTAL EXAMPLE 22 | — | — | — | — | — | — | PRESENT INVENTION EXAMPLE |
| EXPERIMENTAL EXAMPLE 23 | — | — | — | — | — | — | PRESENT INVENTION EXAMPLE |
| EXPERIMENTAL EXAMPLE 24 | 0.02 | — | — | — | 0.0008 | — | PRESENT INVENTION EXAMPLE |

TABLE 1-continued

| | | | | | | | |
|---|---|---|---|---|---|---|---|
| EXPERIMENTAL EXAMPLE 25 | 0.02 | — | — | — | 0.0008 | — | COMPARATIVE EXAMPLE |
| EXPERIMENTAL EXAMPLE 26 | 0.02 | — | — | — | 0.0008 | — | COMPARATIVE EXAMPLE |
| EXPERIMENTAL EXAMPLE 27 | — | 0.006 | — | — | — | — | PRESENT INVENTION EXAMPLE |
| EXPERIMENTAL EXAMPLE 28 | 0.02 | — | — | — | 0.0006 | — | PRESENT INVENTION EXAMPLE |
| EXPERIMENTAL EXAMPLE 29 | 0.02 | — | — | — | — | — | PRESENT INVENTION EXAMPLE |
| EXPERIMENTAL EXAMPLE 30 | — | — | — | — | — | — | PRESENT INVENTION EXAMPLE |

TABLE 2

| | CHEMICAL COMPOSITION (mass %) | | | | | | | | | | | |
|---|---|---|---|---|---|---|---|---|---|---|---|---|
| | C | Si | Mn | P | S | Al | Mo | Ti | Nb | N | Cr | Cu |
| EXPERIMENTAL EXAMPLE 31 | 0.0055 | 0.7 | 0.5 | 0.03 | 0.003 | 0.04 | 0.15 | 0.025 | 0.007 | 0.002 | 0.03 | — |
| EXPERIMENTAL EXAMPLE 32 | 0.0082 | 0.02 | 0.2 | 0.06 | 0.003 | 0.05 | 0.18 | 0.003 | 0.07 | 0.003 | 0.04 | — |
| EXPERIMENTAL EXAMPLE 33 | 0.0082 | 0.02 | 0.2 | 0.06 | 0.003 | 0.05 | 0.18 | 0.003 | 0.07 | 0.003 | 0.04 | — |
| EXPERIMENTAL EXAMPLE 34 | 0.0084 | 0.02 | 0.2 | 0.06 | 0.003 | 0.05 | 0.18 | 0.003 | 0.07 | 0.003 | 0.04 | — |
| EXPERIMENTAL EXAMPLE 35 | 0.0017 | 0.01 | 0.6 | 0.03 | 0.002 | 0.03 | 0.05 | 0.01 | 0.007 | 0.002 | 0.18 | — |
| EXPERIMENTAL EXAMPLE 36 | 0.0017 | 0.01 | 0.6 | 0.03 | 0.002 | 0.03 | 0.05 | 0.01 | 0.007 | 0.002 | 0.18 | — |
| EXPERIMENTAL EXAMPLE 37 | 0.0017 | 0.01 | 0.6 | 0.03 | 0.002 | 0.03 | 0.05 | 0.01 | 0.007 | 0.002 | 0.18 | — |
| EXPERIMENTAL EXAMPLE 38 | 0.0017 | 0.01 | 0.6 | 0.03 | 0.002 | 0.03 | 0.05 | 0.01 | 0.007 | 0.002 | 0.18 | — |
| EXPERIMENTAL EXAMPLE 39 | 0.0062 | 0.1 | 0.8 | 0.03 | 0.003 | 0.04 | 0.13 | 0.08 | 0.003 | 0.002 | 0.03 | 0.02 |
| EXPERIMENTAL EXAMPLE 40 | 0.002 | 1.5 | 0.2 | 0.02 | 0.003 | 0.03 | 0.002 | 0.01 | 0.005 | 0.002 | 0.05 | — |
| EXPERIMENTAL EXAMPLE 41 | 0.002 | 0.02 | 1.3 | 0.02 | 0.003 | 0.03 | 0.002 | 0.01 | 0.005 | 0.002 | 0.05 | — |
| EXPERIMENTAL EXAMPLE 42 | 0.002 | 0.02 | 0.2 | 0.12 | 0.003 | 0.03 | 0.002 | 0.01 | 0.005 | 0.002 | 0.05 | — |
| EXPERIMENTAL EXAMPLE 43 | 0.002 | 0.02 | 0.2 | 0.02 | 0.025 | 0.03 | 0.002 | 0.01 | 0.005 | 0.002 | 0.05 | — |
| EXPERIMENTAL EXAMPLE 44 | 0.002 | 0.02 | 0.2 | 0.02 | 0.003 | 0.004 | 0.1 | 0.01 | 0.005 | 0.002 | 0.05 | — |
| EXPERIMENTAL EXAMPLE 45 | 0.002 | 0.02 | 0.2 | 0.02 | 0.003 | 0.15 | 0.002 | 0.01 | 0.005 | 0.002 | 0.05 | — |
| EXPERIMENTAL EXAMPLE 46 | 0.002 | 0.02 | 0.2 | 0.02 | 0.003 | 0.03 | 0.002 | 0.01 | 0.005 | 0.002 | 0.05 | — |
| EXPERIMENTAL EXAMPLE 47 | 0.002 | 0.02 | 0.2 | 0.02 | 0.003 | 0.03 | 0.42 | 0.01 | 0.005 | 0.002 | 0.05 | — |
| EXPERIMENTAL EXAMPLE 48 | 0.002 | 0.02 | 0.2 | 0.02 | 0.003 | 0.03 | 0.1 | 0.001 | 0.005 | 0.002 | 0.05 | — |
| EXPERIMENTAL EXAMPLE 49 | 0.002 | 0.02 | 0.2 | 0.02 | 0.003 | 0.03 | 0.1 | 0.15 | 0.005 | 0.002 | 0.05 | — |
| EXPERIMENTAL EXAMPLE 50 | 0.002 | 0.02 | 0.2 | 0.02 | 0.003 | 0.03 | 0.1 | 0.01 | 0.001 | 0.002 | 0.05 | — |
| EXPERIMENTAL EXAMPLE 51 | 0.002 | 0.02 | 0.2 | 0.02 | 0.003 | 0.03 | 0.1 | 0.01 | 0.15 | 0.002 | 0.05 | — |
| EXPERIMENTAL EXAMPLE 52 | 0.002 | 0.02 | 0.2 | 0.02 | 0.003 | 0.03 | 0.1 | 0.01 | 0.005 | 0.007 | 0.05 | — |
| EXPERIMENTAL EXAMPLE 53 | 0.002 | 0.02 | 0.2 | 0.02 | 0.003 | 0.03 | 0.1 | 0.01 | 0.005 | 0.002 | 0.001 | — |
| EXPERIMENTAL EXAMPLE 54 | 0.002 | 0.02 | 0.2 | 0.02 | 0.003 | 0.03 | 0.1 | 0.01 | 0.005 | 0.002 | 0.3 | — |
| EXPERIMENTAL EXAMPLE 55 | 0.002 | 0.02 | 0.2 | 0.02 | 0.003 | 0.03 | 0.002 | 0.01 | 0.005 | 0.002 | 0.05 | 1 |
| EXPERIMENTAL EXAMPLE 56 | 0.002 | 0.02 | 0.2 | 0.02 | 0.003 | 0.03 | 0.002 | 0.01 | 0.005 | 0.002 | 0.05 | — |
| EXPERIMENTAL EXAMPLE 57 | 0.013 | 0.02 | 0.7 | 0.03 | 0.002 | 0.03 | 0.03 | 0.006 | 0.005 | 0.003 | 0.05 | — |
| EXPERIMENTAL EXAMPLE 58 | 0.04 | 0.02 | 1.9 | 0.03 | 0.002 | 0.04 | 0.03 | 0.006 | 0.005 | 0.003 | 0.05 | — |
| EXPERIMENTAL EXAMPLE 59 | 0.0006 | 0.02 | 0.5 | 0.03 | 0.003 | 0.03 | 0.1 | 0.01 | 0.005 | 0.002 | 0.05 | — |
| EXPERIMENTAL EXAMPLE 60 | 0.002 | 0.003 | 0.5 | 0.03 | 0.003 | 0.03 | 0.1 | 0.01 | 0.005 | 0.002 | 0.05 | — |
| EXPERIMENTAL EXAMPLE 61 | 0.002 | 0.02 | 0.06 | 0.03 | 0.003 | 0.03 | 0.1 | 0.01 | 0.005 | 0.002 | 0.05 | — |
| EXPERIMENTAL EXAMPLE 62 | 0.002 | 0.02 | 0.5 | 0.03 | 0.003 | 0.03 | 0.1 | 0.01 | 0.005 | 0.0007 | 0.05 | — |
| EXPERIMENTAL EXAMPLE 63 | 0.0015 | 0.02 | 0.1 | 0.01 | 0.003 | 0.03 | 0.1 | 0.01 | 0.005 | 0.002 | 0.02 | 0.01 |
| EXPERIMENTAL EXAMPLE 64 | 0.0015 | 0.02 | 0.1 | 0.01 | 0.003 | 0.03 | 0.1 | 0.01 | 0.005 | 0.002 | 0.02 | 0.01 |
| EXPERIMENTAL EXAMPLE 65 | 0.0015 | 0.02 | 0.1 | 0.01 | 0.003 | 0.03 | 0.1 | 0.01 | 0.005 | 0.002 | 0.02 | 0.01 |

| | CHEMICAL COMPOSITION (mass %) | | | | | | |
|---|---|---|---|---|---|---|---|
| | Ni | Sn | W | V | B | OTHERS | NOTE |
| EXPERIMENTAL EXAMPLE 31 | — | — | — | — | — | — | PRESENT INVENTION EXAMPLE |
| EXPERIMENTAL EXAMPLE 32 | 0.02 | — | — | — | 0.0004 | — | PRESENT INVENTION EXAMPLE |
| EXPERIMENTAL EXAMPLE 33 | 0.02 | — | — | — | 0.0004 | — | PRESENT INVENTION EXAMPLE |
| EXPERIMENTAL EXAMPLE 34 | 0.02 | — | — | — | — | — | PRESENT INVENTION EXAMPLE |
| EXPERIMENTAL EXAMPLE 35 | — | — | — | — | — | — | PRESENT INVENTION EXAMPLE |
| EXPERIMENTAL EXAMPLE 36 | — | — | — | — | — | — | PRESENT INVENTION EXAMPLE |
| EXPERIMENTAL EXAMPLE 37 | — | — | — | — | — | — | COMPARATIVE EXAMPLE |
| EXPERIMENTAL EXAMPLE 38 | — | — | — | — | — | — | COMPARATIVE EXAMPLE |
| EXPERIMENTAL EXAMPLE 39 | 0.01 | — | — | — | 0.002 | — | PRESENT INVENTION EXAMPLE |
| EXPERIMENTAL EXAMPLE 40 | — | — | — | — | — | — | COMPARATIVE EXAMPLE |
| EXPERIMENTAL EXAMPLE 41 | — | — | — | — | — | — | COMPARATIVE EXAMPLE |
| EXPERIMENTAL EXAMPLE 42 | — | — | — | — | — | — | COMPARATIVE EXAMPLE |
| EXPERIMENTAL EXAMPLE 43 | — | — | — | — | — | — | COMPARATIVE EXAMPLE |
| EXPERIMENTAL EXAMPLE 44 | — | — | — | — | — | — | COMPARATIVE EXAMPLE |
| EXPERIMENTAL EXAMPLE 45 | — | — | — | — | — | — | COMPARATIVE EXAMPLE |
| EXPERIMENTAL EXAMPLE 46 | — | — | — | — | — | — | COMPARATIVE EXAMPLE |
| EXPERIMENTAL EXAMPLE 47 | — | — | — | — | — | — | COMPARATIVE EXAMPLE |
| EXPERIMENTAL EXAMPLE 48 | — | — | — | — | — | — | COMPARATIVE EXAMPLE |
| EXPERIMENTAL EXAMPLE 49 | — | — | — | — | — | — | COMPARATIVE EXAMPLE |
| EXPERIMENTAL EXAMPLE 50 | — | — | — | — | — | — | COMPARATIVE EXAMPLE |
| EXPERIMENTAL EXAMPLE 51 | — | — | — | — | — | — | COMPARATIVE EXAMPLE |
| EXPERIMENTAL EXAMPLE 52 | — | — | — | — | — | — | COMPARATIVE EXAMPLE |
| EXPERIMENTAL EXAMPLE 53 | — | — | — | — | — | — | COMPARATIVE EXAMPLE |
| EXPERIMENTAL EXAMPLE 54 | — | — | — | — | — | — | COMPARATIVE EXAMPLE |

TABLE 2-continued

| | | | | | | | |
|---|---|---|---|---|---|---|---|
| EXPERIMENTAL EXAMPLE 55 | 0.8 | 0.1 | — | — | — | — | COMPARATIVE EXAMPLE |
| EXPERIMENTAL EXAMPLE 56 | — | — | — | — | 0.007 | — | COMPARATIVE EXAMPLE |
| EXPERIMENTAL EXAMPLE 57 | — | — | — | — | — | — | COMPARATIVE EXAMPLE |
| EXPERIMENTAL EXAMPLE 58 | — | — | — | — | — | — | COMPARATIVE EXAMPLE |
| EXPERIMENTAL EXAMPLE 59 | — | — | — | — | — | — | COMPARATIVE EXAMPLE |
| EXPERIMENTAL EXAMPLE 60 | — | — | — | — | — | — | COMPARATIVE EXAMPLE |
| EXPERIMENTAL EXAMPLE 61 | — | — | — | — | — | — | COMPARATIVE EXAMPLE |
| EXPERIMENTAL EXAMPLE 62 | — | — | — | — | — | — | COMPARATIVE EXAMPLE |
| EXPERIMENTAL EXAMPLE 63 | — | — | 0.1 | 0.05 | — | — | PRESENT INVENTION EXAMPLE |
| EXPERIMENTAL EXAMPLE 64 | — | — | — | — | — | Ca: 0.002<br>Mg: 0.002 | PRESENT INVENTION EXAMPLE |
| EXPERIMENTAL EXAMPLE 65 | — | — | — | — | — | La: 0.001<br>Ce: 0.004 | PRESENT INVENTION EXAMPLE |

TABLE 3

| | ANNEALING CONDITION | | | | |
|---|---|---|---|---|---|
| | ANNEALING TEMPERATURE (° C.) | MAINTAINING TIME (s) | AVERAGE COOLING SPEED (° C./s) | SHEET THICKNESS (mm) | PLATING CONDITION PLATING METHOD |
| EXPERIMENTAL EXAMPLE 1 | 800 | 60 | 40 | 0.6 | NONE |
| EXPERIMENTAL EXAMPLE 2 | 870 | 60 | 40 | 0.6 | NONE |
| EXPERIMENTAL EXAMPLE 3 | 650 | 60 | 40 | 0.6 | NONE |
| EXPERIMENTAL EXAMPLE 4 | 800 | 60 | 1 | 0.6 | NONE |
| EXPERIMENTAL EXAMPLE 5 | 800 | 60 | 3 | 0.6 | NONE |
| EXPERIMENTAL EXAMPLE 6 | 800 | 60 | 40 | 0.6 | NONE |
| EXPERIMENTAL EXAMPLE 7 | 800 | 60 | 40 | 0.6 | NONE |
| EXPERIMENTAL EXAMPLE 8 | 800 | 60 | 40 | 0.6 | NONE |
| EXPERIMENTAL EXAMPLE 9 | 800 | 60 | 40 | 0.6 | NONE |
| EXPERIMENTAL EXAMPLE 10 | 800 | 60 | 40 | 0.6 | NONE |
| EXPERIMENTAL EXAMPLE 11 | 800 | 60 | 40 | 0.6 | NONE |
| EXPERIMENTAL EXAMPLE 12 | 800 | 60 | 40 | 0.6 | NONE |
| EXPERIMENTAL EXAMPLE 13 | 800 | 60 | 40 | 0.6 | NONE |
| EXPERIMENTAL EXAMPLE 14 | 800 | 60 | 40 | 0.6 | NONE |
| EXPERIMENTAL EXAMPLE 15 | 800 | 60 | 40 | 0.6 | NONE |
| EXPERIMENTAL EXAMPLE 16 | 800 | 60 | 40 | 0.6 | NONE |
| EXPERIMENTAL EXAMPLE 17 | 800 | 60 | 40 | 0.6 | NONE |
| EXPERIMENTAL EXAMPLE 18 | 800 | 60 | 40 | 0.6 | NONE |
| EXPERIMENTAL EXAMPLE 19 | 800 | 60 | 40 | 0.6 | NONE |
| EXPERIMENTAL EXAMPLE 20 | 800 | 60 | 40 | 0.6 | NONE |
| EXPERIMENTAL EXAMPLE 21 | 800 | 60 | 40 | 0.6 | NONE |
| EXPERIMENTAL EXAMPLE 22 | 800 | 60 | 10 | 0.6 | HOT-DIP GALVANIZATION |
| EXPERIMENTAL EXAMPLE 23 | 800 | 60 | 10 | 0.6 | ALLOYED HOT-DIP GALVANIZATION |
| EXPERIMENTAL EXAMPLE 24 | 820 | 60 | 40 | 0.7 | NONE |
| EXPERIMENTAL EXAMPLE 25 | 820 | 300 | 40 | 0.7 | NONE |
| EXPERIMENTAL EXAMPLE 26 | 640 | 15 | 40 | 0.7 | NONE |
| EXPERIMENTAL EXAMPLE 27 | 820 | 60 | 50 | 0.7 | NONE |
| EXPERIMENTAL EXAMPLE 28 | 820 | 60 | 50 | 0.8 | NONE |
| EXPERIMENTAL EXAMPLE 29 | 820 | 60 | 50 | 0.8 | NONE |
| EXPERIMENTAL EXAMPLE 30 | 820 | 60 | 50 | 0.8 | NONE |

| | PLATING CONDITION | | TEMPER ROLLING CONDITION | | | |
|---|---|---|---|---|---|---|
| | GALVANIZATION BATH TEMPERATURE (° C.) | ALLOYED TREATMENT TEMPERATURE (° C.) | LINE LOAD A (N/m) | TENSION B (N/m) | B/A | REDUC-TION RATIO (%) |
| EXPERIMENTAL EXAMPLE 1 | — | — | $4 \times 10^6$ | $8 \times 10^7$ | 20 | 1 |
| EXPERIMENTAL EXAMPLE 2 | — | — | $4 \times 10^6$ | $8 \times 10^7$ | 20 | 1 |
| EXPERIMENTAL EXAMPLE 3 | — | — | $4 \times 10^6$ | $8 \times 10^7$ | 20 | 1 |
| EXPERIMENTAL EXAMPLE 4 | — | — | $4 \times 10^6$ | $8 \times 10^7$ | 20 | 1 |
| EXPERIMENTAL EXAMPLE 5 | — | — | $4 \times 10^6$ | $8 \times 10^7$ | 20 | 1 |
| EXPERIMENTAL EXAMPLE 6 | — | — | $5 \times 10^5$ | $1 \times 10^7$ | 20 | 1 |
| EXPERIMENTAL EXAMPLE 7 | — | — | $5 \times 10^7$ | $1 \times 10^7$ | 0.2 | 1 |
| EXPERIMENTAL EXAMPLE 8 | — | — | $4 \times 10^6$ | $4 \times 10^6$ | 1 | 1 |
| EXPERIMENTAL EXAMPLE 9 | — | — | $4 \times 10^6$ | $3 \times 10^8$ | 75 | 1 |
| EXPERIMENTAL EXAMPLE 10 | — | — | $1 \times 10^7$ | $1 \times 10^7$ | 1 | 1 |
| EXPERIMENTAL EXAMPLE 11 | — | — | $1 \times 10^6$ | $2 \times 10^8$ | 200 | 1 |
| EXPERIMENTAL EXAMPLE 12 | — | — | $8 \times 10^5$ | $1 \times 10^8$ | 125 | 1 |
| EXPERIMENTAL EXAMPLE 13 | — | — | $3 \times 10^7$ | $1 \times 10^8$ | 3.3 | 1 |

TABLE 3-continued

| | | | | | | |
|---|---|---|---|---|---|---|
| EXPERIMENTAL EXAMPLE 14 | — | — | $2 \times 10^6$ | $1.5 \times 10^7$ | 7.5 | 1 |
| EXPERIMENTAL EXAMPLE 15 | — | — | $1 \times 10^6$ | $2 \times 10^7$ | 20 | 1 |
| EXPERIMENTAL EXAMPLE 16 | — | — | $5 \times 10^7$ | $1.5 \times 10^8$ | 3 | 1 |
| EXPERIMENTAL EXAMPLE 17 | — | — | $1.5 \times 10^7$ | $3 \times 10^7$ | 2 | 1 |
| EXPERIMENTAL EXAMPLE 18 | — | — | $4 \times 10^6$ | $8 \times 10^7$ | 20 | 0.1 |
| EXPERIMENTAL EXAMPLE 19 | — | — | $4 \times 10^6$ | $8 \times 10^7$ | 20 | 0.4 |
| EXPERIMENTAL EXAMPLE 20 | — | — | $4 \times 10^6$ | $8 \times 10^7$ | 20 | 1.7 |
| EXPERIMENTAL EXAMPLE 21 | — | — | $4 \times 10^6$ | $8 \times 10^7$ | 20 | 2.4 |
| EXPERIMENTAL EXAMPLE 22 | 450 | — | $6 \times 10^6$ | $8 \times 10^7$ | 13.3 | 1 |
| EXPERIMENTAL EXAMPLE 23 | 450 | 500 | $8 \times 10^6$ | $8 \times 10^7$ | 10 | 1 |
| EXPERIMENTAL EXAMPLE 24 | — | — | $4 \times 10^6$ | $8 \times 10^7$ | 20 | 1 |
| EXPERIMENTAL EXAMPLE 25 | — | — | $4 \times 10^6$ | $8 \times 10^7$ | 20 | 1 |
| EXPERIMENTAL EXAMPLE 26 | — | — | $6 \times 10^6$ | $8 \times 10^7$ | 11.3 | 1 |
| EXPERIMENTAL EXAMPLE 27 | — | — | $2 \times 10^6$ | $1.5 \times 10^7$ | 7.5 | 1 |
| EXPERIMENTAL EXAMPLE 28 | — | — | $1 \times 10^6$ | $2 \times 10^7$ | 20 | 1 |
| EXPERIMENTAL EXAMPLE 29 | — | — | $2 \times 10^7$ | $1.5 \times 10^8$ | 7.5 | 1 |
| EXPERIMENTAL EXAMPLE 30 | — | — | $1.5 \times 10^7$ | $3 \times 10^7$ | 2 | 1 |

TABLE 4

| | ANNEALING CONDITION | | | | |
|---|---|---|---|---|---|
| | ANNEALING TEMPERATURE (° C.) | MAINTAINING TIME (s) | AVERAGE COOLING SPEED (° C./s) | SHEET THICKNESS (mm) | PLATING CONDITION PLATING METHOD |
| EXPERIMENTAL EXAMPLE 31 | 820 | 60 | 10 | 0.8 | ALLOYED HOT-DIP GALVANIZATION |
| EXPERIMENTAL EXAMPLE 32 | 780 | 60 | 60 | 0.8 | NONE |
| EXPERIMENTAL EXAMPLE 33 | 780 | 60 | 60 | 0.8 | ALLOYED HOT-DIP GALVANIZATION |
| EXPERIMENTAL EXAMPLE 34 | 800 | 60 | 40 | 0.7 | NONE |
| EXPERIMENTAL EXAMPLE 35 | 800 | 60 | 40 | 0.7 | NONE |
| EXPERIMENTAL EXAMPLE 36 | 800 | 60 | 40 | 0.7 | HOT-DIP GALVANIZATION |
| EXPERIMENTAL EXAMPLE 37 | 800 | 60 | 40 | 0.7 | NONE |
| EXPERIMENTAL EXAMPLE 38 | 800 | 60 | 40 | 0.7 | NONE |
| EXPERIMENTAL EXAMPLE 39 | 800 | 60 | 40 | 0.7 | NONE |
| EXPERIMENTAL EXAMPLE 40 | 800 | 60 | 40 | 0.7 | NONE |
| EXPERIMENTAL EXAMPLE 41 | 800 | 60 | 40 | 0.7 | NONE |
| EXPERIMENTAL EXAMPLE 42 | 800 | 60 | 40 | 0.7 | NONE |
| EXPERIMENTAL EXAMPLE 43 | 800 | 60 | 40 | 0.7 | NONE |
| EXPERIMENTAL EXAMPLE 44 | 800 | 60 | 40 | 0.7 | NONE |
| EXPERIMENTAL EXAMPLE 45 | 800 | 60 | 40 | 0.7 | NONE |
| EXPERIMENTAL EXAMPLE 46 | 800 | 60 | 40 | 0.7 | NONE |
| EXPERIMENTAL EXAMPLE 47 | 800 | 60 | 40 | 0.7 | NONE |
| EXPERIMENTAL EXAMPLE 48 | 800 | 60 | 40 | 0.7 | NONE |
| EXPERIMENTAL EXAMPLE 49 | 800 | 60 | 40 | 0.7 | NONE |
| EXPERIMENTAL EXAMPLE 50 | 800 | 60 | 40 | 0.7 | NONE |
| EXPERIMENTAL EXAMPLE 51 | 800 | 60 | 40 | 0.7 | NONE |
| EXPERIMENTAL EXAMPLE 52 | 800 | 60 | 40 | 0.7 | NONE |
| EXPERIMENTAL EXAMPLE 53 | 800 | 60 | 40 | 0.7 | NONE |
| EXPERIMENTAL EXAMPLE 54 | 800 | 60 | 40 | 0.7 | NONE |
| EXPERIMENTAL EXAMPLE 55 | 800 | 60 | 40 | 0.7 | NONE |
| EXPERIMENTAL EXAMPLE 56 | 800 | 60 | 40 | 0.7 | NONE |
| EXPERIMENTAL EXAMPLE 57 | 800 | 60 | 40 | 0.7 | NONE |
| EXPERIMENTAL EXAMPLE 58 | 800 | 60 | 40 | 0.7 | NONE |
| EXPERIMENTAL EXAMPLE 59 | 800 | 60 | 40 | 0.7 | NONE |
| EXPERIMENTAL EXAMPLE 60 | 800 | 60 | 40 | 0.7 | NONE |
| EXPERIMENTAL EXAMPLE 61 | 800 | 60 | 40 | 0.7 | NONE |
| EXPERIMENTAL EXAMPLE 62 | 800 | 60 | 40 | 0.7 | NONE |
| EXPERIMENTAL EXAMPLE 63 | 800 | 60 | 40 | 0.6 | NONE |
| EXPERIMENTAL EXAMPLE 64 | 800 | 60 | 40 | 0.6 | NONE |
| EXPERIMENTAL EXAMPLE 65 | 800 | 60 | 40 | 0.6 | NONE |

| | PLATING CONDITION | | TEMPER ROLLING CONDITION | | | |
|---|---|---|---|---|---|---|
| | GALVANIZATION BATH TEMPERATURE (° C.) | ALLOYED TREATMENT TEMPERATURE (° C.) | LINE LOAD A (N/m) | TENSION B (N/m) | A/B | REDUCTION RATIO (%) |
| EXPERIMENTAL EXAMPLE 31 | 450 | 500 | $4 \times 10^6$ | $8 \times 10^7$ | 20 | 1 |
| EXPERIMENTAL EXAMPLE 32 | — | — | $4 \times 10^6$ | $8 \times 10^7$ | 20 | 1 |

TABLE 4-continued

| | | | | | | |
|---|---|---|---|---|---|---|
| EXPERIMENTAL EXAMPLE 33 | 450 | 530 | $4 \times 10^6$ | $8 \times 10^7$ | 20 | 1 |
| EXPERIMENTAL EXAMPLE 34 | — | — | $4 \times 10^6$ | $8 \times 10^7$ | 20 | 1 |
| EXPERIMENTAL EXAMPLE 35 | — | — | $4 \times 10^6$ | $8 \times 10^7$ | 20 | 1 |
| EXPERIMENTAL EXAMPLE 36 | 450 | — | $4 \times 10^6$ | $8 \times 10^7$ | 20 | 1 |
| EXPERIMENTAL EXAMPLE 37 | — | — | $5 \times 10^5$ | $1 \times 10^7$ | 20 | 1 |
| EXPERIMENTAL EXAMPLE 38 | — | — | $5 \times 10^7$ | $1 \times 10^7$ | 0.2 | 1 |
| EXPERIMENTAL EXAMPLE 39 | — | — | $4 \times 10^6$ | $8 \times 10^7$ | 20 | 1.4 |
| EXPERIMENTAL EXAMPLE 40 | — | — | $4 \times 10^6$ | $8 \times 10^7$ | 20 | 1 |
| EXPERIMENTAL EXAMPLE 41 | — | — | $4 \times 10^6$ | $8 \times 10^7$ | 20 | 1 |
| EXPERIMENTAL EXAMPLE 42 | — | — | $4 \times 10^6$ | $8 \times 10^7$ | 20 | 1 |
| EXPERIMENTAL EXAMPLE 43 | — | — | $4 \times 10^6$ | $8 \times 10^7$ | 20 | 1 |
| EXPERIMENTAL EXAMPLE 44 | — | — | $4 \times 10^6$ | $8 \times 10^7$ | 20 | 1 |
| EXPERIMENTAL EXAMPLE 45 | — | — | $4 \times 10^6$ | $8 \times 10^7$ | 20 | 1 |
| EXPERIMENTAL EXAMPLE 46 | — | — | $4 \times 10^6$ | $8 \times 10^7$ | 20 | 1 |
| EXPERIMENTAL EXAMPLE 47 | — | — | $4 \times 10^6$ | $8 \times 10^7$ | 20 | 1 |
| EXPERIMENTAL EXAMPLE 48 | — | — | $4 \times 10^6$ | $8 \times 10^7$ | 20 | 1 |
| EXPERIMENTAL EXAMPLE 49 | — | — | $4 \times 10^6$ | $8 \times 10^7$ | 20 | 1 |
| EXPERIMENTAL EXAMPLE 50 | — | — | $8 \times 10^6$ | $8 \times 10^7$ | 10 | 1 |
| EXPERIMENTAL EXAMPLE 51 | — | — | $8 \times 10^6$ | $8 \times 10^7$ | 10 | 1 |
| EXPERIMENTAL EXAMPLE 52 | — | — | $8 \times 10^6$ | $8 \times 10^7$ | 10 | 1 |
| EXPERIMENTAL EXAMPLE 53 | — | — | $8 \times 10^6$ | $8 \times 10^7$ | 10 | 1 |
| EXPERIMENTAL EXAMPLE 54 | — | — | $8 \times 10^6$ | $8 \times 10^7$ | 10 | 1 |
| EXPERIMENTAL EXAMPLE 55 | — | — | $8 \times 10^6$ | $8 \times 10^7$ | 10 | 1 |
| EXPERIMENTAL EXAMPLE 56 | — | — | $8 \times 10^6$ | $8 \times 10^7$ | 10 | 1 |
| EXPERIMENTAL EXAMPLE 57 | — | — | $8 \times 10^6$ | $8 \times 10^7$ | 10 | 1 |
| EXPERIMENTAL EXAMPLE 58 | — | — | $8 \times 10^6$ | $8 \times 10^7$ | 10 | 1 |
| EXPERIMENTAL EXAMPLE 59 | — | — | $8 \times 10^6$ | $8 \times 10^7$ | 10 | 1 |
| EXPERIMENTAL EXAMPLE 60 | — | — | $8 \times 10^6$ | $8 \times 10^7$ | 10 | 1 |
| EXPERIMENTAL EXAMPLE 61 | — | — | $8 \times 10^6$ | $8 \times 10^7$ | 10 | 1 |
| EXPERIMENTAL EXAMPLE 62 | — | — | $8 \times 10^6$ | $8 \times 10^7$ | 10 | 1 |
| EXPERIMENTAL EXAMPLE 63 | — | — | $4 \times 10^6$ | $8 \times 10^7$ | 20 | 1 |
| EXPERIMENTAL EXAMPLE 64 | — | — | $4 \times 10^6$ | $8 \times 10^7$ | 20 | 1 |
| EXPERIMENTAL EXAMPLE 65 | — | — | $4 \times 10^6$ | $8 \times 10^7$ | 20 | 1 |

TABLE 5

| | FERRITE | MINIMUM DISLOCATION DENSITY (/m$^2$) | | | |
|---|---|---|---|---|---|
| | AVERAGE GRAIN DIAMETER (μm) | PORTION HAVING ½ THICKNESS OF SHEET THICKNESS | SURFACE LAYER PORTION | AVERAGE DISLOCATION DENSITY (/m2) | YPEL (%) |
| EXPERIMENTAL EXAMPLE 1 | 20 | $3 \times 10^{13}$ | $6 \times 10^{13}$ | $8 \times 10^{13}$ | 0 |
| EXPERIMENTAL EXAMPLE 2 | 35 | $4 \times 10^{12}$ | $5 \times 10^{13}$ | $7 \times 10^{13}$ | 0.8 |
| EXPERIMENTAL EXAMPLE 3 | 10 | $3 \times 10^{13}$ | $7 \times 10^{13}$ | $8 \times 10^{13}$ | 0 |
| EXPERIMENTAL EXAMPLE 4 | 20 | $2 \times 10^{13}$ | $6 \times 10^{13}$ | $7 \times 10^{13}$ | 0 |
| EXPERIMENTAL EXAMPLE 5 | 18 | $2 \times 10^{13}$ | $6 \times 10^{13}$ | $7 \times 10^{13}$ | 0 |
| EXPERIMENTAL EXAMPLE 6 | 20 | $3 \times 10^{12}$ | $8 \times 10^{12}$ | $8 \times 10^{12}$ | 1.8 |
| EXPERIMENTAL EXAMPLE 7 | 19 | $6 \times 10^{14}$ | $2 \times 10^{13}$ | $4 \times 10^{15}$ | 0 |
| EXPERIMENTAL EXAMPLE 8 | 20 | $3 \times 10^{12}$ | $2 \times 10^{13}$ | $5 \times 10^{13}$ | 0.7 |
| EXPERIMENTAL EXAMPLE 9 | 21 | $2 \times 10^{13}$ | $3 \times 10^{13}$ | $4 \times 10^{13}$ | 0 |
| EXPERIMENTAL EXAMPLE 10 | 20 | $4 \times 10^{12}$ | $3 \times 10^{13}$ | $3 \times 10^{13}$ | 0 |
| EXPERIMENTAL EXAMPLE 11 | 22 | $3 \times 10^{12}$ | $4 \times 10^{13}$ | $6 \times 10^{13}$ | 0.6 |
| EXPERIMENTAL EXAMPLE 12 | 19 | $1 \times 10^{12}$ | $8 \times 10^{12}$ | $1 \times 10^{13}$ | 0.9 |
| EXPERIMENTAL EXAMPLE 13 | 20 | $2 \times 10^{12}$ | $5 \times 10^{13}$ | $6 \times 10^{13}$ | 0 |
| EXPERIMENTAL EXAMPLE 14 | 20 | $1 \times 10^{13}$ | $4 \times 10^{13}$ | $6 \times 10^{13}$ | 0 |
| EXPERIMENTAL EXAMPLE 15 | 21 | $7 \times 10^{12}$ | $4 \times 10^{13}$ | $8 \times 10^{13}$ | 0 |
| EXPERIMENTAL EXAMPLE 16 | 21 | $1 \times 10^{13}$ | $8 \times 10^{13}$ | $1 \times 10^{14}$ | 0 |
| EXPERIMENTAL EXAMPLE 17 | 19 | $6 \times 10^{12}$ | $5 \times 10^{13}$ | $7 \times 10^{13}$ | 0 |
| EXPERIMENTAL EXAMPLE 18 | 20 | $1 \times 10^{12}$ | $4 \times 10^{12}$ | $4 \times 10^{12}$ | 2.1 |
| EXPERIMENTAL EXAMPLE 19 | 19 | $6 \times 10^{12}$ | $7 \times 10^{12}$ | $1 \times 10^{13}$ | 0.3 |
| EXPERIMENTAL EXAMPLE 20 | 20 | $8 \times 10^{13}$ | $5 \times 10^{14}$ | $7 \times 10^{14}$ | 0 |
| EXPERIMENTAL EXAMPLE 21 | 20 | $4 \times 10^{14}$ | $2 \times 10^{15}$ | $5 \times 10^{15}$ | 0 |
| EXPERIMENTAL EXAMPLE 22 | 18 | $3 \times 10^{13}$ | $7 \times 10^{13}$ | $8 \times 10^{13}$ | 0 |
| EXPERIMENTAL EXAMPLE 23 | 18 | $5 \times 10^{13}$ | $8 \times 10^{13}$ | $1 \times 10^{14}$ | 0 |
| EXPERIMENTAL EXAMPLE 24 | 23 | $3 \times 10^{13}$ | $7 \times 10^{13}$ | $8 \times 10^{13}$ | 0 |
| EXPERIMENTAL EXAMPLE 25 | 33 | $4 \times 10^{12}$ | $6 \times 10^{13}$ | $7 \times 10^{13}$ | 0.3 |
| EXPERIMENTAL EXAMPLE 26 | 4 | $3 \times 10^{13}$ | $7 \times 10^{13}$ | $8 \times 10^{13}$ | 0.7 |
| EXPERIMENTAL EXAMPLE 27 | 18 | $1 \times 10^{13}$ | $4 \times 10^{13}$ | $6 \times 10^{13}$ | 0 |
| EXPERIMENTAL EXAMPLE 28 | 21 | $7 \times 10^{12}$ | $4 \times 10^{13}$ | $8 \times 10^{13}$ | 0 |
| EXPERIMENTAL EXAMPLE 29 | 19 | $1 \times 10^{13}$ | $8 \times 10^{13}$ | $1 \times 10^{14}$ | 0 |
| EXPERIMENTAL EXAMPLE 30 | 20 | $6 \times 10^{12}$ | $5 \times 10^{13}$ | $7 \times 10^{13}$ | 0 |

TABLE 5-continued

| | BH AMOUNT (MPa) | DECREASED AMOUNT AFTER BH (MPa) | NOTE |
|---|---|---|---|
| EXPERIMENTAL EXAMPLE 1 | 35 | 10 | PRESENT INVENTION EXAMPLE |
| EXPERIMENTAL EXAMPLE 2 | 35 | 30 | COMPARATIVE EXAMPLE |
| EXPERIMENTAL EXAMPLE 3 | 15 | 25 | COMPARATIVE EXAMPLE |
| EXPERIMENTAL EXAMPLE 4 | 10 | 30 | COMPARATIVE EXAMPLE |
| EXPERIMENTAL EXAMPLE 5 | 30 | 20 | PRESENT INVENTION EXAMPLE |
| EXPERIMENTAL EXAMPLE 6 | 20 | 25 | COMPARATIVE EXAMPLE |
| EXPERIMENTAL EXAMPLE 7 | 25 | 10 | COMPARATIVE EXAMPLE |
| EXPERIMENTAL EXAMPLE 8 | 30 | 30 | COMPARATIVE EXAMPLE |
| EXPERIMENTAL EXAMPLE 9 | 31 | 13 | PRESENT INVENTION EXAMPLE |
| EXPERIMENTAL EXAMPLE 10 | 30 | 30 | COMPARATIVE EXAMPLE |
| EXPERIMENTAL EXAMPLE 11 | 32 | 30 | COMPARATIVE EXAMPLE |
| EXPERIMENTAL EXAMPLE 12 | 31 | 30 | COMPARATIVE EXAMPLE |
| EXPERIMENTAL EXAMPLE 13 | 22 | 18 | COMPARATIVE EXAMPLE |
| EXPERIMENTAL EXAMPLE 14 | 32 | 12 | PRESENT INVENTION EXAMPLE |
| EXPERIMENTAL EXAMPLE 15 | 31 | 12 | PRESENT INVENTION EXAMPLE |
| EXPERIMENTAL EXAMPLE 16 | 32 | 11 | PRESENT INVENTION EXAMPLE |
| EXPERIMENTAL EXAMPLE 17 | 33 | 8 | PRESENT INVENTION EXAMPLE |
| EXPERIMENTAL EXAMPLE 18 | 34 | 32 | COMPARATIVE EXAMPLE |
| EXPERIMENTAL EXAMPLE 19 | 32 | 17 | PRESENT INVENTION EXAMPLE |
| EXPERIMENTAL EXAMPLE 20 | 31 | 13 | PRESENT INVENTION EXAMPLE |
| EXPERIMENTAL EXAMPLE 21 | 19 | 19 | COMPARATIVE EXAMPLE |
| EXPERIMENTAL EXAMPLE 22 | 33 | 9 | PRESENT INVENTION EXAMPLE |
| EXPERIMENTAL EXAMPLE 23 | 32 | 10 | PRESENT INVENTION EXAMPLE |
| EXPERIMENTAL EXAMPLE 24 | 33 | 12 | PRESENT INVENTION EXAMPLE |
| EXPERIMENTAL EXAMPLE 25 | 30 | 31 | COMPARATIVE EXAMPLE |
| EXPERIMENTAL EXAMPLE 26 | 32 | 27 | COMPARATIVE EXAMPLE |
| EXPERIMENTAL EXAMPLE 27 | 32 | 8 | PRESENT INVENTION EXAMPLE |
| EXPERIMENTAL EXAMPLE 28 | 31 | 9 | PRESENT INVENTION EXAMPLE |
| EXPERIMENTAL EXAMPLE 29 | 32 | 10 | PRESENT INVENTION EXAMPLE |
| EXPERIMENTAL EXAMPLE 30 | 33 | 12 | PRESENT INVENTION EXAMPLE |

TABLE 6

| | FERRITE | MINIMUM DISLOCATION DENSITY (/m$^2$) | | | |
|---|---|---|---|---|---|
| | AVERAGE GRAIN DIAMETER (μm) | PORTION HAVING ½ THICKNESS OF SHEET THICKNESS | SURFACE LAYER PORTION | AVERAGE DISLOCATION DENSITY (/m2) | YPEL (%) |
| EXPERIMENTAL EXAMPLE 31 | 20 | $3 \times 10^{13}$ | $6 \times 10^{13}$ | $8 \times 10^{13}$ | 0 |
| EXPERIMENTAL EXAMPLE 32 | 11 | $3 \times 10^{13}$ | $7 \times 10^{13}$ | $8 \times 10^{13}$ | 0 |
| EXPERIMENTAL EXAMPLE 33 | 12 | $4 \times 10^{13}$ | $7 \times 10^{13}$ | $1 \times 10^{14}$ | 0 |
| EXPERIMENTAL EXAMPLE 34 | 21 | $1 \times 10^{13}$ | $5 \times 10^{13}$ | $7 \times 10^{13}$ | 0.4 |
| EXPERIMENTAL EXAMPLE 35 | 21 | $1 \times 10^{13}$ | $5 \times 10^{13}$ | $7 \times 10^{13}$ | 0 |
| EXPERIMENTAL EXAMPLE 36 | 19 | $2 \times 10^{13}$ | $5 \times 10^{13}$ | $8 \times 10^{13}$ | 0 |
| EXPERIMENTAL EXAMPLE 37 | 19 | $4 \times 10^{12}$ | $4 \times 10^{13}$ | $6 \times 10^{13}$ | 0.4 |
| EXPERIMENTAL EXAMPLE 38 | 20 | $6 \times 10^{14}$ | $2 \times 10^{15}$ | $4 \times 10^{15}$ | 0 |
| EXPERIMENTAL EXAMPLE 39 | 20 | $4 \times 10^{13}$ | $7 \times 10^{13}$ | $8 \times 10^{13}$ | 0 |
| EXPERIMENTAL EXAMPLE 40 | 20 | $4 \times 10^{12}$ | $7 \times 10^{13}$ | $8 \times 10^{13}$ | 0.8 |
| EXPERIMENTAL EXAMPLE 41 | 16 | $3 \times 10^{13}$ | $6 \times 10^{13}$ | $8 \times 10^{13}$ | 1.2 |
| EXPERIMENTAL EXAMPLE 42 | 21 | $2 \times 10^{13}$ | $5 \times 10^{13}$ | $7 \times 10^{13}$ | 0.9 |
| EXPERIMENTAL EXAMPLE 43 | 17 | $2 \times 10^{13}$ | $5 \times 10^{13}$ | $7 \times 10^{13}$ | 1.1 |
| EXPERIMENTAL EXAMPLE 44 | 24 | $6 \times 10^{13}$ | $7 \times 10^{13}$ | $7 \times 10^{13}$ | 0.8 |
| EXPERIMENTAL EXAMPLE 45 | 23 | $1 \times 10^{13}$ | $7 \times 10^{13}$ | $8 \times 10^{13}$ | 0.8 |
| EXPERIMENTAL EXAMPLE 46 | 22 | $8 \times 10^{13}$ | $3 \times 10^{13}$ | $7 \times 10^{13}$ | 1.4 |
| EXPERIMENTAL EXAMPLE 47 | 16 | $4 \times 10^{13}$ | $8 \times 10^{13}$ | $1 \times 10^{14}$ | 0 |
| EXPERIMENTAL EXAMPLE 48 | 32 | $2 \times 10^{12}$ | $2 \times 10^{13}$ | $5 \times 10^{13}$ | 0.6 |
| EXPERIMENTAL EXAMPLE 49 | 12 | $4 \times 10^{13}$ | $8 \times 10^{13}$ | $1 \times 10^{14}$ | 0 |
| EXPERIMENTAL EXAMPLE 50 | 32 | $2 \times 10^{12}$ | $1 \times 10^{13}$ | $4 \times 10^{13}$ | 0.6 |
| EXPERIMENTAL EXAMPLE 51 | 10 | $4 \times 10^{13}$ | $7 \times 10^{13}$ | $1 \times 10^{14}$ | 0 |
| EXPERIMENTAL EXAMPLE 52 | 20 | $4 \times 10^{12}$ | $2 \times 10^{13}$ | $7 \times 10^{13}$ | 1.5 |
| EXPERIMENTAL EXAMPLE 53 | 20 | $2 \times 10^{13}$ | $7 \times 10^{13}$ | $8 \times 10^{13}$ | 0.6 |
| EXPERIMENTAL EXAMPLE 54 | 20 | $3 \times 10^{13}$ | $6 \times 10^{13}$ | $1 \times 10^{14}$ | 0 |
| EXPERIMENTAL EXAMPLE 55 | 22 | $9 \times 10^{13}$ | $7 \times 10^{13}$ | $1 \times 10^{14}$ | 0.6 |
| EXPERIMENTAL EXAMPLE 56 | 18 | $6 \times 10^{13}$ | $7 \times 10^{13}$ | $1 \times 10^{14}$ | 0.8 |
| EXPERIMENTAL EXAMPLE 57 | 17 | $3 \times 10^{13}$ | $7 \times 10^{13}$ | $1 \times 10^{14}$ | 1.4 |
| EXPERIMENTAL EXAMPLE 58 | 11 | $4 \times 10^{13}$ | $7 \times 10^{13}$ | $1 \times 10^{14}$ | 0.9 |
| EXPERIMENTAL EXAMPLE 59 | 20 | $3 \times 10^{13}$ | $8 \times 10^{13}$ | $9 \times 10^{13}$ | 0 |
| EXPERIMENTAL EXAMPLE 60 | 20 | $2 \times 10^{13}$ | $5 \times 10^{13}$ | $7 \times 10^{13}$ | 0 |
| EXPERIMENTAL EXAMPLE 61 | 20 | $4 \times 10^{13}$ | $5 \times 10^{13}$ | $7 \times 10^{13}$ | 0 |

TABLE 6-continued

| | | | | | |
|---|---|---|---|---|---|
| EXPERIMENTAL EXAMPLE 62 | 20 | $2 \times 10^{13}$ | $6 \times 10^{13}$ | $8 \times 10^{13}$ | 0 |
| EXPERIMENTAL EXAMPLE 63 | 18 | $5 \times 10^{13}$ | $6 \times 10^{13}$ | $9 \times 10^{13}$ | 0 |
| EXPERIMENTAL EXAMPLE 64 | 20 | $3 \times 10^{13}$ | $6 \times 10^{13}$ | $8 \times 10^{13}$ | 0 |
| EXPERIMENTAL EXAMPLE 65 | 20 | $3 \times 10^{13}$ | $6 \times 10^{13}$ | $8 \times 10^{13}$ | 0 |

| | BH AMOUNT (MPa) | DECREASED AMOUNT AFTER BH (MPa) | NOTE |
|---|---|---|---|
| EXPERIMENTAL EXAMPLE 31 | 35 | 10 | PRESENT INVENTION EXAMPLE |
| EXPERIMENTAL EXAMPLE 32 | 35 | 11 | PRESENT INVENTION EXAMPLE |
| EXPERIMENTAL EXAMPLE 33 | 30 | 15 | PRESENT INVENTION EXAMPLE |
| EXPERIMENTAL EXAMPLE 34 | 37 | 18 | PRESENT INVENTION EXAMPLE |
| EXPERIMENTAL EXAMPLE 35 | 31 | 14 | PRESENT INVENTION EXAMPLE |
| EXPERIMENTAL EXAMPLE 36 | 30 | 13 | PRESENT INVENTION EXAMPLE |
| EXPERIMENTAL EXAMPLE 37 | 22 | 27 | COMPARATIVE EXAMPLE |
| EXPERIMENTAL EXAMPLE 38 | 27 | 19 | COMPARATIVE EXAMPLE |
| EXPERIMENTAL EXAMPLE 39 | 30 | 8 | PRESENT INVENTION EXAMPLE |
| EXPERIMENTAL EXAMPLE 40 | 30 | 30 | COMPARATIVE EXAMPLE |
| EXPERIMENTAL EXAMPLE 41 | 32 | 24 | COMPARATIVE EXAMPLE |
| EXPERIMENTAL EXAMPLE 42 | 31 | 24 | COMPARATIVE EXAMPLE |
| EXPERIMENTAL EXAMPLE 43 | 29 | 21 | COMPARATIVE EXAMPLE |
| EXPERIMENTAL EXAMPLE 44 | 30 | 21 | COMPARATIVE EXAMPLE |
| EXPERIMENTAL EXAMPLE 45 | 32 | 29 | COMPARATIVE EXAMPLE |
| EXPERIMENTAL EXAMPLE 46 | 30 | 24 | COMPARATIVE EXAMPLE |
| EXPERIMENTAL EXAMPLE 47 | 25 | 8 | COMPARATIVE EXAMPLE |
| EXPERIMENTAL EXAMPLE 48 | 30 | 24 | COMPARATIVE EXAMPLE |
| EXPERIMENTAL EXAMPLE 49 | 9 | 8 | COMPARATIVE EXAMPLE |
| EXPERIMENTAL EXAMPLE 50 | 32 | 24 | COMPARATIVE EXAMPLE |
| EXPERIMENTAL EXAMPLE 51 | 8 | 9 | COMPARATIVE EXAMPLE |
| EXPERIMENTAL EXAMPLE 52 | 32 | 23 | COMPARATIVE EXAMPLE |
| EXPERIMENTAL EXAMPLE 53 | 31 | 12 | COMPARATIVE EXAMPLE |
| EXPERIMENTAL EXAMPLE 54 | 26 | 13 | COMPARATIVE EXAMPLE |
| EXPERIMENTAL EXAMPLE 55 | 33 | 25 | COMPARATIVE EXAMPLE |
| EXPERIMENTAL EXAMPLE 56 | 30 | 24 | COMPARATIVE EXAMPLE |
| EXPERIMENTAL EXAMPLE 57 | 43 | 26 | COMPARATIVE EXAMPLE |
| EXPERIMENTAL EXAMPLE 58 | 46 | 38 | COMPARATIVE EXAMPLE |
| EXPERIMENTAL EXAMPLE 59 | 27 | 6 | COMPARATIVE EXAMPLE |
| EXPERIMENTAL EXAMPLE 60 | 26 | 13 | COMPARATIVE EXAMPLE |
| EXPERIMENTAL EXAMPLE 61 | 28 | 12 | COMPARATIVE EXAMPLE |
| EXPERIMENTAL EXAMPLE 62 | 27 | 9 | COMPARATIVE EXAMPLE |
| EXPERIMENTAL EXAMPLE 63 | 36 | 10 | PRESENT INVENTION EXAMPLE |
| EXPERIMENTAL EXAMPLE 64 | 35 | 10 | PRESENT INVENTION EXAMPLE |
| EXPERIMENTAL EXAMPLE 65 | 35 | 10 | PRESENT INVENTION EXAMPLE |

What is claimed is:

1. A strain aging hardening steel sheet excellent in aging resistance after baking finish comprising:

in mass %,

C: 0.0010 to 0.010%;

Si: 0.005 to 1.0%;

Mn: 0.08 to 1.0%;

P: 0.003 to 0.10%;

S: 0.0005 to 0.020%;

Al: 0.010 to 0.10%;

Cr: 0.005 to 0.20%;

Mo: 0.005 to 0.20%;

Ti: 0.002 to 0.10%;

Nb: 0.002 to 0.10%;

N: 0.001 to 0.005%; and a balance being composed of Fe and inevitable impurities, wherein a ferrite fraction is 98% or more, an average grain diameter of ferrite is 5 to 30 μm, a minimum value of dislocation density in a portion having a ½ thickness of a sheet thickness and a minimum value of dislocation density in a surface layer portion are each $5\times10^{12}/m^2$ or more, and an average dislocation density falls within a range of $5\times10^{12}$ to $1\times10^{15}/m^2$.

2. The strain aging hardening steel sheet excellent in aging resistance after baking finish according to claim 1, further comprising:

in mass %, B: 0.005% or less.

3. The strain aging hardening steel sheet excellent in aging resistance after baking finish according to claim 1, further comprising:

0.3 mass % or less of one type or two types or more selected from Cu, Ni, Sn, W, and V in total.

4. The strain aging hardening steel sheet excellent in aging resistance after baking finish according to claim 1, further comprising:

0.02 mass % or less of one type or two types or more selected from Ca, Mg, and REM in total.

5. The strain aging hardening steel sheet excellent in aging resistance after baking finish according to claim 1, wherein a plated layer is provided on at least one front surface.

6. A manufacturing method of a strain aging hardening steel sheet excellent in aging resistance after baking finish comprising:

hot rolling a steel slab containing:

in mass %,

C: 0.0010 to 0.010%;

Si: 0.005 to 1.0%;

Mn: 0.08 to 1.0%;
P: 0.003 to 0.10%;
S: 0.0005 to 0.020%;
Al: 0.010 to 0.10%;
Cr: 0.005 to 0.20%;
Mo: 0.005 to 0.20%;
Ti: 0.002 to 0.10%;
Nb: 0.002 to 0.10%;
N: 0.001 to 0.005%; and
a balance being composed of Fe and inevitable impurities;
next, performing cold rolling;
then, performing annealing at an annealing temperature falling within a range of 700 to 850° C.;
performing cooling with an average cooling speed from 700 to 500° C. of 2° C./s or more; and
performing temper rolling under a condition that a line load A is set to fall within a range of $1\times10^6$ to $2\times10^7$ N/m, tension B is set to fall within a range of $1\times10^7$ to $2\times10^8$ N/m$^2$, and the tension B/the line load A is set to fall within, a range of 2 to 120, and further a reduction ratio is set to 0.2 to 2.0%.

7. The manufacturing method of the strain aging hardening steel sheet excellent in aging resistance after baking finish according to claim 6, wherein
the steel slab further contains, in mass %, B: 0.005 or less.

8. The manufacturing method of the strain aging hardening steel sheet excellent in aging resistance after baking finish according to claim 6, wherein
the steel slab further contains 0.3 mass % or less of one type or two types or more selected from Cu, Ni, Sn, W, and V in total.

9. The manufacturing method of the strain aging hardening steel sheet excellent in aging resistance after baking finish according to claim 6, wherein
the steel slab further contains 0.02 mass % or less of one type or two types or more selected from Ca, Mg, and REM in total.

10. The manufacturing method of the strain aging hardening steel sheet excellent in aging resistance after baking finish according to claim 6, further comprising:
before said temper rolling, providing a plated layer on at least one front surface.

11. The strain aging hardening steel sheet excellent in aging resistance after baking finish according to claim 2, wherein
a plated layer is provided on at least one front surface.

12. The strain aging hardening steel sheet excellent in aging resistance after baking finish according to claim 3, wherein
a plated layer is provided on at least one front surface.

13. The strain aging hardening steel sheet excellent in aging resistance after baking finish according to claim 4, wherein
a plated layer is provided on at least one front surface.

14. The manufacturing method of the strain aging hardening steel sheet excellent in aging resistance after baking finish according to claim 7, further comprising:
before said temper rolling, providing a plated layer on at least one front surface.

15. The manufacturing method of the strain aging hardening steel sheet excellent in aging resistance after baking finish according to claim 8, further comprising:
before said temper rolling, providing a plated layer on at least one front surface.

16. The manufacturing method of the strain aging hardening steel sheet excellent in aging resistance after baking finish according to claim 9, further comprising:
before said temper rolling, providing a plated layer on at least one front surface.

* * * * *